US007257850B1

(12) United States Patent
Tekulve

(10) Patent No.: US 7,257,850 B1
(45) Date of Patent: Aug. 21, 2007

(54) ARTICULATING BED FRAME

(75) Inventor: Daniel R. Tekulve, Batesville, IN (US)

(73) Assignee: Med-Mizer, Inc., Batesville, IN (US)

( * ) Notice: Subject to any disclaimer, the term of this patent is extended or adjusted under 35 U.S.C. 154(b) by 30 days.

(21) Appl. No.: 10/974,620

(22) Filed: Oct. 27, 2004

Related U.S. Application Data

(63) Continuation-in-part of application No. 10/359,087, filed on Feb. 5, 2003, now Pat. No. 6,826,793.

(51) Int. Cl.
*A47C 21/08* (2006.01)

(52) U.S. Cl. ..... 5/430; 5/428

(58) Field of Classification Search ..... 5/425, 5/428, 430
See application file for complete search history.

(56) References Cited

U.S. PATENT DOCUMENTS

| | | | | |
|---|---|---|---|---|
| 1,658,780 | A | 2/1928 | Nixon | |
| 2,026,153 | A | 12/1935 | Wright et al. | |
| 2,189,325 | A | 2/1940 | Rich | |
| 2,349,701 | A | 5/1944 | Buttikofer et al. | |
| 2,651,785 | A | 9/1953 | Berner | |
| 3,051,965 | A | 9/1962 | Szemplak et al. | |
| 3,105,247 | A | 10/1963 | Katz | |
| 3,191,195 | A | 6/1965 | Schlackman et al. | |
| 3,195,153 | A * | 7/1965 | Armstrong et al. | 5/430 |
| 3,234,570 | A * | 2/1966 | Hutt | 5/430 |
| 3,261,639 | A | 7/1966 | Phillips | |
| 3,267,493 | A | 8/1966 | Pruim et al. | |
| 3,351,961 | A * | 11/1967 | Daniels et al. | 5/430 |
| 3,447,170 | A | 6/1969 | Spitz | |
| 3,506,989 | A * | 4/1970 | Knight et al. | 5/430 |
| 3,526,008 | A * | 9/1970 | Pruim | 5/430 |

(Continued)

FOREIGN PATENT DOCUMENTS

FR 2647654 A1 * 12/1990

OTHER PUBLICATIONS

Brochure—Carroll Healthcare, Feb. 22, 2002.

*Primary Examiner*—Robert G. Santos
(74) *Attorney, Agent, or Firm*—Woodard, Emhardt, Moriarty, McNett & Henry LLP

(57) ABSTRACT

An articulating bed frame includes a main frame; a back section; first and second linkage assemblies, each being pivotally connected at spaced apart first and third ends to the back section and pivotally connected at opposing, spaced apart and respective second and fourth ends to the main frame; an upper leg section; a third linkage assembly pivotally connected at opposing fifth and sixth ends to the upper leg section and the main frame; a support link assembly connecting the upper leg section for sliding and pivotal movement with the main frame; a seat section pivotally connected at opposing ends to the back section and the upper leg section; a lower leg section pivotally connected to the upper leg section and freely supported atop a forward end of the main frame; a drive assembly connected between the back section and the third linkage assembly and operable to extend and retract to articulate the bed frame between a fully reclined position and a fully inclined position; and, a side rail assembly connected to the main frame and including a handle having a down position and an up position and including connection apparatus for permitting articulation between the down and up positions.

23 Claims, 21 Drawing Sheets

U.S. PATENT DOCUMENTS 3,593,350 A 7/1971 Knight et al.
3,821,821 A 7/1974 Burst et al.
3,887,951 A 6/1975 Yates et al.
3,930,273 A * 1/1976 Stern ..... 5/430
3,958,283 A 5/1976 Adams et al.
3,972,081 A 8/1976 Stern et al.
4,025,972 A 5/1977 Adams et al.
4,095,296 A 6/1978 Ferro
4,097,039 A 6/1978 Fischer
4,097,940 A 7/1978 Tekulve et al.
4,258,445 A 3/1981 Zur
4,344,422 A 8/1982 Immel
4,349,924 A 9/1982 Zur
4,395,786 A 8/1983 Casey et al.
4,509,217 A * 4/1985 Therrien ..... 5/430
4,559,656 A 12/1985 Foster
4,592,104 A 6/1986 Foster et al.
4,821,351 A 4/1989 Bergenwall
5,063,623 A 11/1991 Bathrick et al.
5,095,562 A 3/1992 Alexander
5,105,486 A 4/1992 Peterson
5,129,117 A * 7/1992 Celestina et al. ..... 5/430
5,161,274 A 11/1992 Hayes et al.
5,165,129 A 11/1992 Rohm
5,205,004 A 4/1993 Hayes et al.
5,245,718 A 9/1993 Krauska
5,329,657 A 7/1994 Bartley et al.
5,392,479 A 2/1995 Liao
5,479,665 A 1/1996 Cassidy et al.
RE35,201 E 4/1996 Krauska
5,515,561 A 5/1996 Suggitt et al.
5,535,464 A 7/1996 Salonica
5,537,701 A 7/1996 Elliott
5,568,661 A 10/1996 Bathrick et al.
5,577,279 A 11/1996 Foster et al.
5,640,730 A 6/1997 Godette
5,678,267 A * 10/1997 Kinder ..... 5/430
5,708,997 A 1/1998 Foster et al.
5,715,548 A * 2/1998 Weismiller et al. ..... 5/430
5,724,685 A * 3/1998 Weismiller et al. ..... 5/600
5,732,423 A * 3/1998 Weismiller et al. ..... 5/430
5,832,549 A * 11/1998 Le Pallec et al. ..... 5/430
5,870,784 A 2/1999 Elliott
5,933,888 A 8/1999 Foster et al.
5,940,910 A * 8/1999 Weismiller et al. ..... 5/600
6,006,379 A 12/1999 Hensley
6,112,345 A 9/2000 Foster et al.
6,161,236 A 12/2000 Carroll
6,163,903 A * 12/2000 Weismiller et al. ..... 5/610
6,163,904 A 12/2000 Royson
6,182,310 B1 * 2/2001 Weismiller et al. ..... 5/425
6,209,157 B1 4/2001 Hensley
6,230,344 B1 5/2001 Thompson et al.
6,230,346 B1 5/2001 Branson et al.
6,276,011 B1 8/2001 Antinori
6,336,235 B1 * 1/2002 Ruehl ..... 5/610
6,339,855 B1 * 1/2002 Socha et al. ..... 5/93.1
6,351,861 B1 3/2002 Shows et al.
6,357,065 B1 3/2002 Adams
6,360,386 B1 3/2002 Chuang
6,374,436 B1 4/2002 Foster et al.
6,446,283 B1 * 9/2002 Heimbrock et al. ..... 5/425
6,516,480 B2 2/2003 Elliott
6,611,979 B2 * 9/2003 Welling et al. ..... 5/624
6,640,361 B2 * 11/2003 Heimbrock et al. ..... 5/430
6,658,680 B2 * 12/2003 Osborne et al. ..... 5/600
6,691,346 B2 * 2/2004 Osborne et al. ..... 5/600
6,694,548 B2 2/2004 Foster et al.
6,725,474 B2 4/2004 Foster et al.
6,728,982 B2 * 5/2004 Lemire et al. ..... 5/603
6,751,815 B2 * 6/2004 Heimbrock et al. ..... 5/53.1
6,779,209 B2 * 8/2004 Ganance ..... 5/430
6,826,793 B2 * 12/2004 Tekulve ..... 5/618
6,880,189 B2 * 4/2005 Welling et al. ..... 5/624
6,957,461 B2 * 10/2005 Osborne et al. ..... 5/618
6,978,500 B2 * 12/2005 Osborne et al. ..... 5/600
7,000,272 B2 * 2/2006 Allen et al. ..... 5/624
7,017,208 B2 * 3/2006 Weismiller et al. ..... 5/600
7,082,630 B2 * 8/2006 Castonguay et al. ..... 5/430
7,107,637 B2 * 9/2006 Kuek et al. ..... 5/430
2001/0032362 A1 * 10/2001 Welling et al. ..... 5/600
2002/0002742 A1 * 1/2002 Osborne et al. ..... 5/600
2002/0059679 A1 * 5/2002 Weismiller et al. ..... 5/610
2002/0066142 A1 * 6/2002 Osborne et al. ..... 5/600
2002/0078505 A1 6/2002 Brooke et al.
2002/0116760 A1 8/2002 Foster et al.
2002/0144348 A1 * 10/2002 Ganance ..... 5/600
2003/0019035 A1 * 1/2003 Heimbrock et al. ..... 5/428
2003/0019036 A1 1/2003 Foster et al.
2003/0028966 A1 * 2/2003 Lemire et al. ..... 5/603
2004/0025253 A1 * 2/2004 Heimbrock et al. ..... 5/425
2004/0034936 A1 * 2/2004 Welling et al. ..... 5/624
2004/0128765 A1 * 7/2004 Osborne et al. ..... 5/600
2004/0148704 A1 * 8/2004 Tekulve ..... 5/618
2004/0177445 A1 * 9/2004 Osborne et al. ..... 5/600
2004/0237195 A1 * 12/2004 Ganance ..... 5/430
2005/0144720 A1 * 7/2005 Poulin et al. ..... 5/425
2006/0085912 A1 * 4/2006 Kuek et al. ..... 5/430
2006/0107460 A1 * 5/2006 Wiggins et al. ..... 5/430

* cited by examiner

ARTICULATING BED FRAME

REFERENCE TO RELATED APPLICATIONS

This application is a continuation-in-part of U.S. patent application Ser. No. 10/359,087 filed Feb. 5, 2003 now U.S. Pat. No. 6,826,793.

FIELD OF THE INVENTION

The present invention relates to bed frames, and more particularly to an articulating bed frame for home, nursing home and hospital healthcare.

BACKGROUND OF THE INVENTION

Beds and bed frames constructed for home, nursing and hospital healthcare environments provide for articulation of the frame to tilt one or more sections for the patient's comfort and/or care. With the push of a button or lever, the back section can be made to tilt between a completely flat, reclined position and a forward, inclined position, or one or more leg sections may be made to bend or tilt between a generally flat and horizontal position and a drawn-up, bent position. More particularly, since most beds are positioned against a wall, some beds have back sections that hug the wall when inclined (raised), which provides additional space at the foot end. This also allows patients to stay within reach of bed side cabinets. To accomplish this, the existing designs of such bed frames typically comprise multiple sliding frames that retract with pivoting linkages that are heavy and costly to manufacture. In addition, the movement of such members may define a path that is larger than the underlying mattress footprint, which thus takes up more space unnecessarily.

What is desired is a bed frame that is lighter, cheaper to manufacture, has a smaller operating footprint, and still hugs the wall when inclined.

SUMMARY OF THE INVENTION

The present invention provides a bed frame that may be articulated between a generally flat and horizontal position and a back-inclined position, all while maintaining a substantially wall-hugging configuration at the head of the bed frame.

Generally speaking, an articulating bed frame includes a main frame; a back section; first and second linkage assemblies, each being pivotally connected at spaced apart first and third ends to the back section and pivotally connected at opposing, spaced apart and respective second and fourth ends to the main frame; an upper leg section; a third linkage assembly pivotally connected at opposing fifth and sixth ends to the upper leg section and the main frame; a support link assembly connecting the upper leg section for sliding and pivotal movement with the main frame; a seat section pivotally connected at opposing ends to the back section and the upper leg section; a lower leg section pivotally connected to the upper leg section and freely supported atop a forward end of the main frame; a drive assembly connected between the back section and the third linkage assembly and operable to extend and retract to articulate the bed frame between a fully reclined position and a fully inclined position; and, a side rail assembly connected to the main frame and including a handle having a down position and an up position and including connection apparatus for permitting articulation between the down and up positions.

It is an object of the present invention to provide an improved bed with articulating side rail for hospital, home and nursing care applications.

Further objects and advantages will become apparent from the following description of the preferred embodiment.

DESCRIPTION OF THE PREFERRED EMBODIMENT

Figure 1:
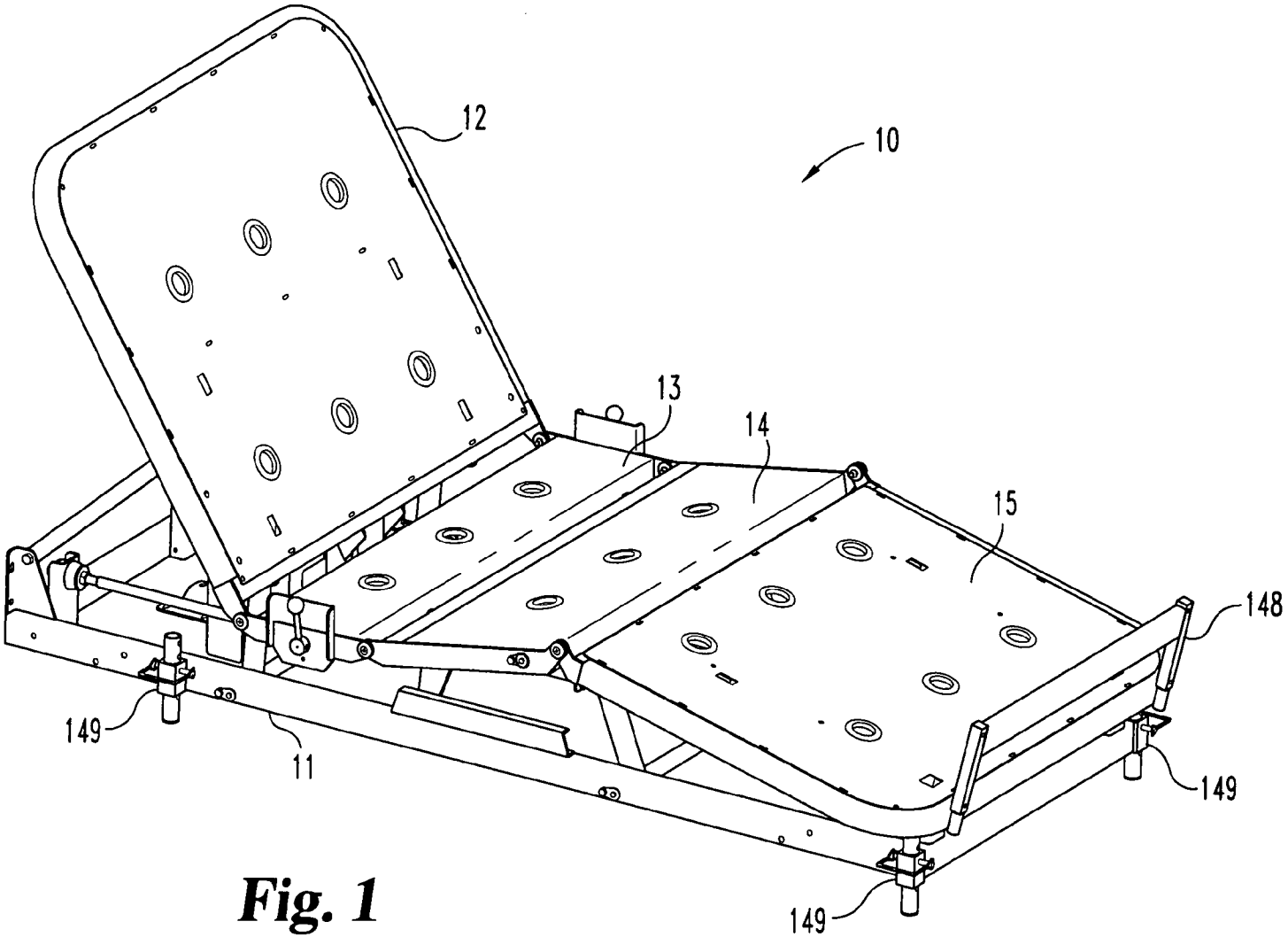
FIG. 1 is a top, perspective view of an articulating bed frame 10 in accordance the present invention and shown in the fully inclined position.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 5:
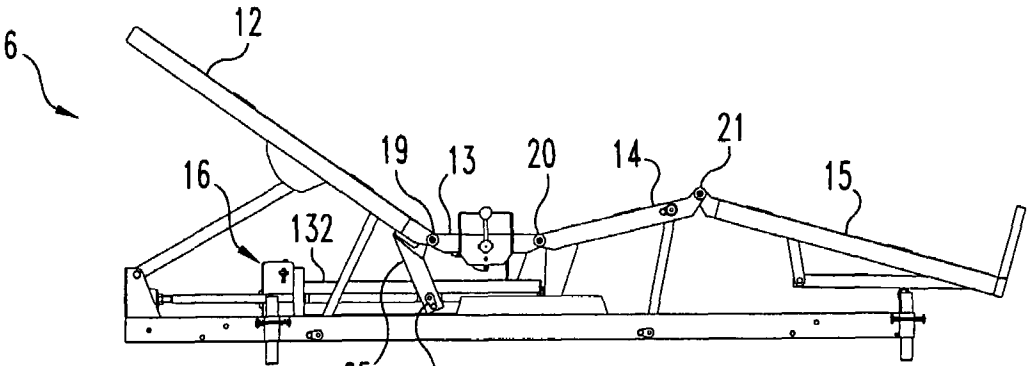
FIG. 5 is a side view of the articulating bed frame 10 of FIG. 4.
Figure 6:
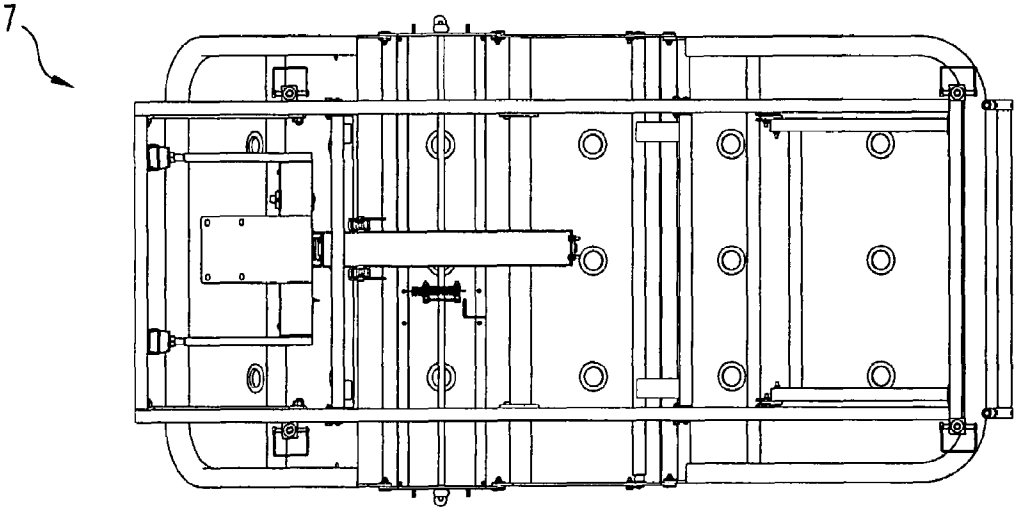
FIG. 6 is a bottom view of the articulating bed frame 10 of FIG. 1 and shown in the fully inclined position 7.

Referring to FIGS. 1-7, there is shown an articulating bed frame 10 in accordance with the present invention. Bed frame 10 can be articulated between a fully reclined position 5 shown in FIGS. 2 and 3 and a fully inclined position 7 shown in FIGS. 7 and 8, as well as all positions in between, such as intermediate position 6 shown in FIG. 5. Bed frame 10 generally includes a main frame 11, a back section 12, a seat section 13, an upper leg section 14, a lower leg section 15 and an articulation drive assembly indicated generally at 16 (FIG. 5). Sections 12-15 are pivotally interconnected along parallel, horizontal axes 19, 20 and 21, as shown.

Figure 3:
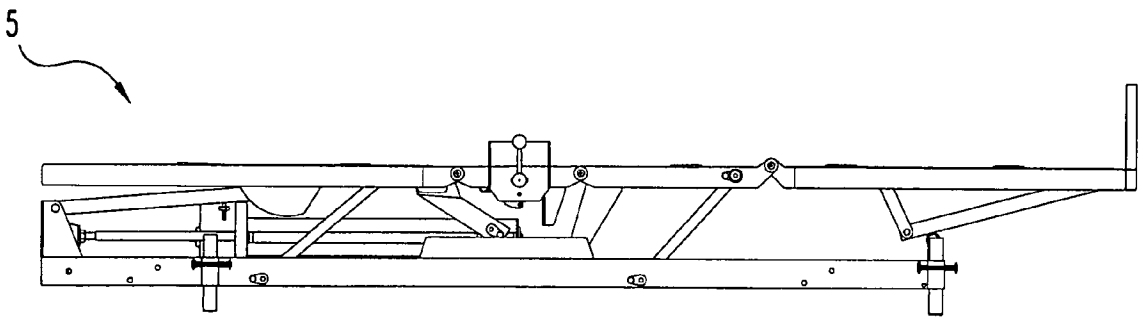
FIG. 3 is a side view of the articulating bed frame 10 of FIG. 2.
Figure 4:
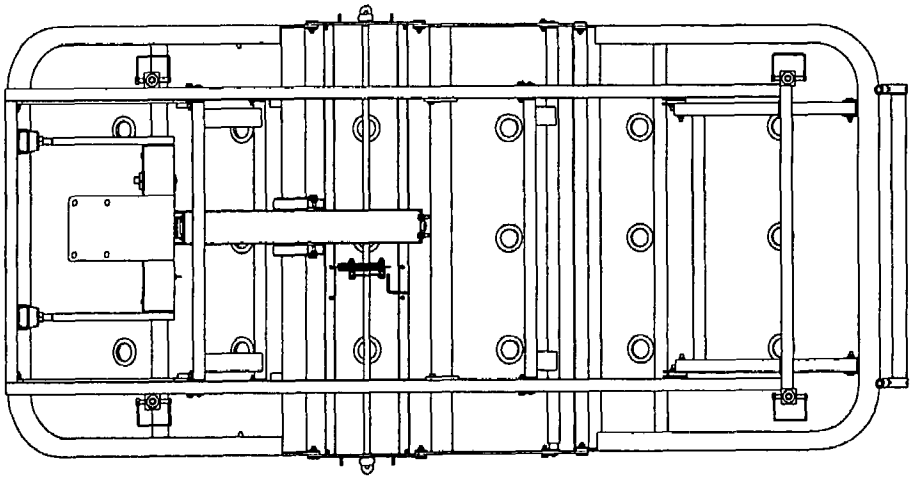
FIG. 4 is a bottom view of the articulating bed frame 10 of FIG. 1 and shown in a partially inclined position 6.
Figure 7:
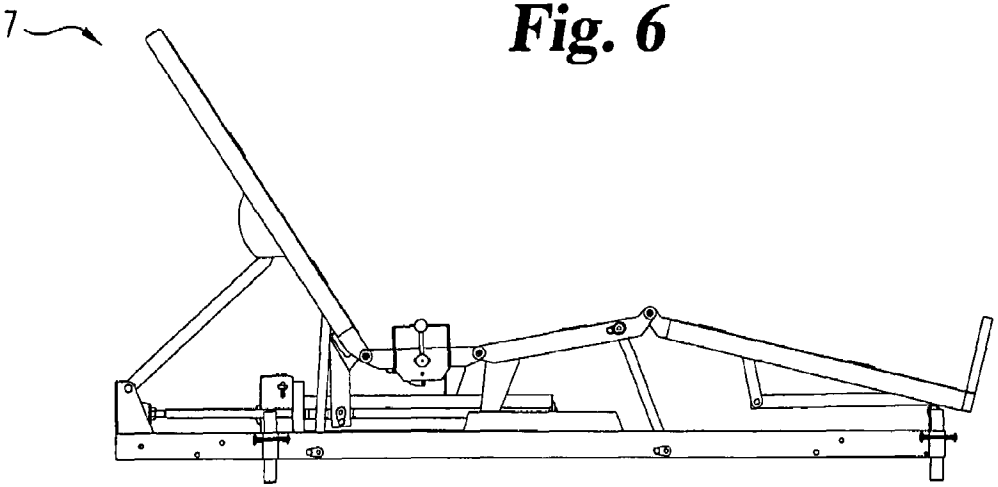
FIG. 7 is a side view of the articulating bed frame 10 of FIG. 6.
Figure 8:
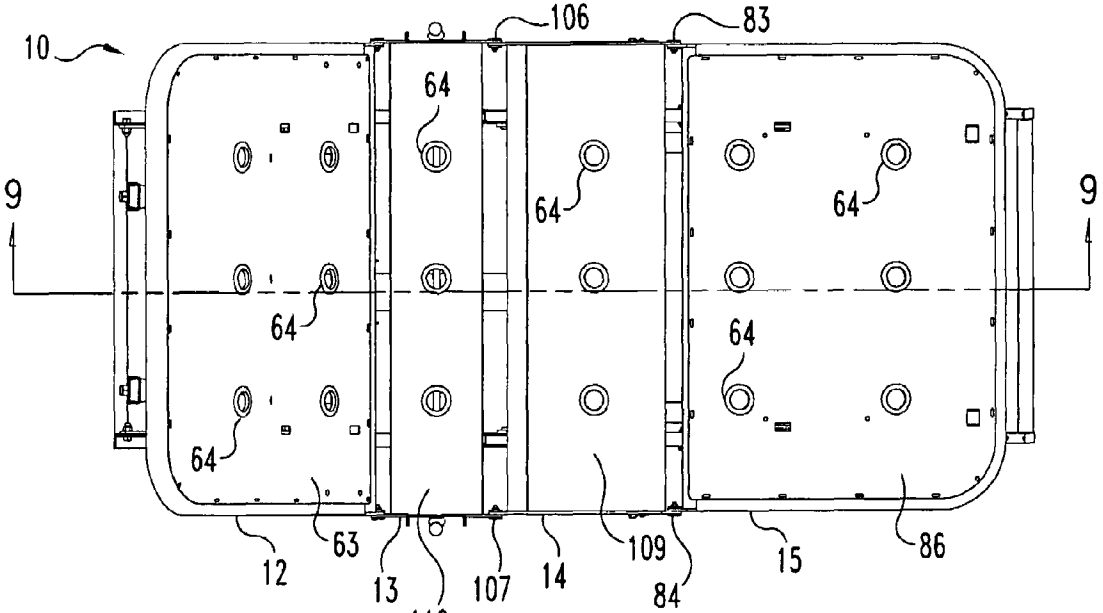
FIG. 8 is a top view of the articulating bed frame 10 of FIG. 6.

The fully reclined position, as used herein, refers to the condition where all the bed sections members (back 12, seat 13, upper leg 14 and lower leg 15) are juxtaposed in a generally horizontal and co-planar position, as shown in FIG. 3. The fully inclined position, as used herein, refers to the condition where the same bed sections, through their pivotal interconnections, are tilted relative to each other as far from the fully reclined position as their linkages will allow, thereby inclining the back section 12 and drawing in the leg sections 14 and 15, as shown in FIG. 7, to form a slightly inverted "V" shape. Thus, the fully reclined and fully inclined positions represent the extremes of articulation of bed frame 10. Alternative embodiments contemplate that bed sections 12-15 may be in different positions for these extremes than are shown herein. For example, in one embodiment, the fully reclined position may have back section 12 pivoted beyond horizontal so that the patient's head is lowered below the rest of his body.

Figure 9:
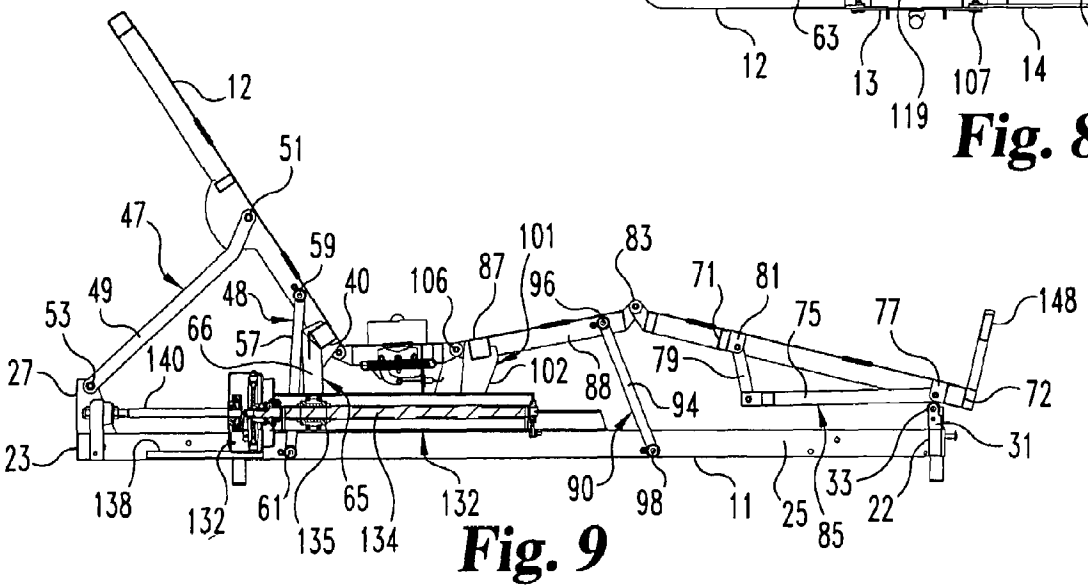
FIG. 9 is a side, cross-sectional view of the articulating bed frame 10 of FIG. 8 taken along the lines 9-9 and viewed in the direction of the arrows.
Figure 10:
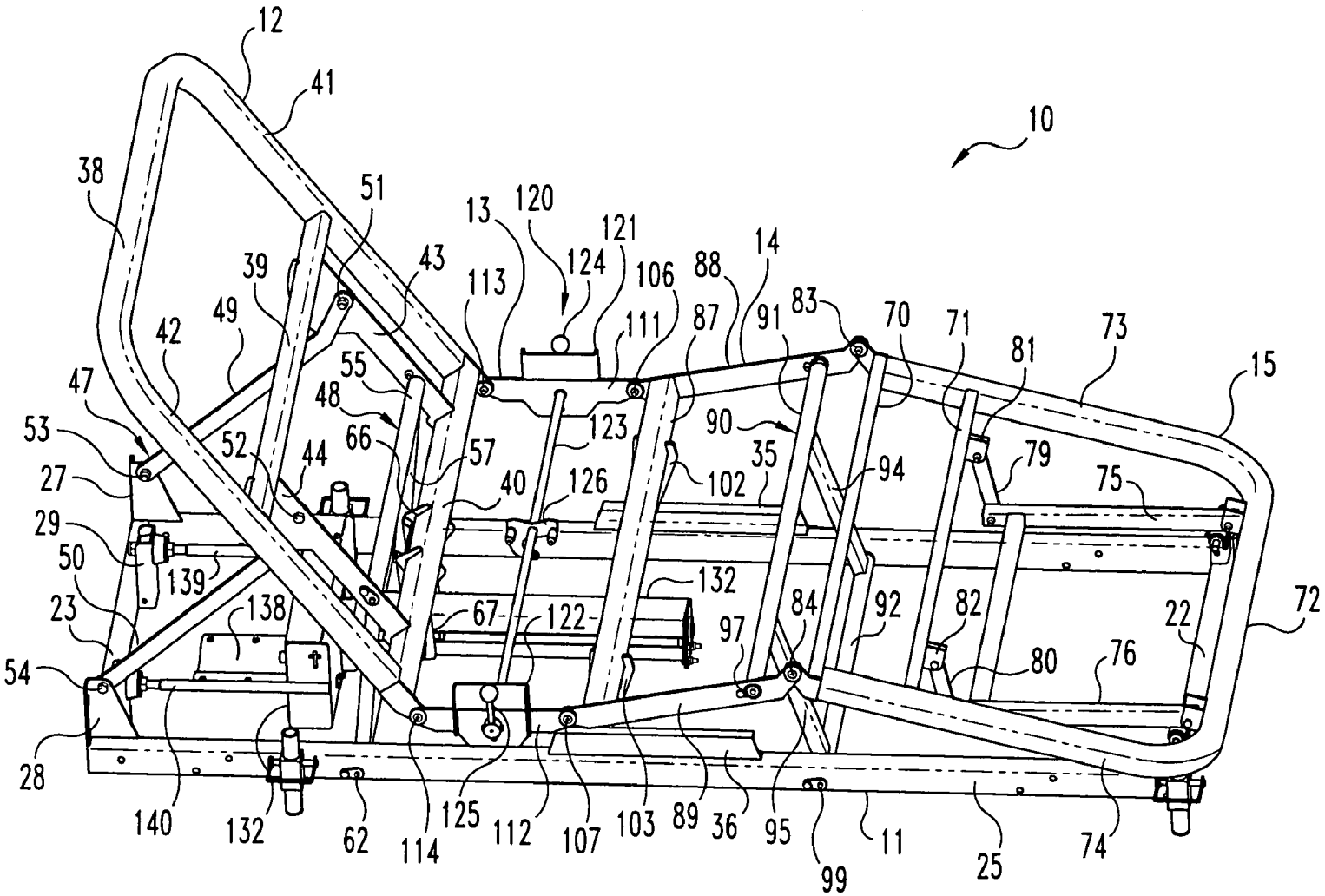
FIG. 10 is a top, perspective view of the articulating bed frame 10 of FIG. 1 with several components removed for viewing clarity.
Figure 11:
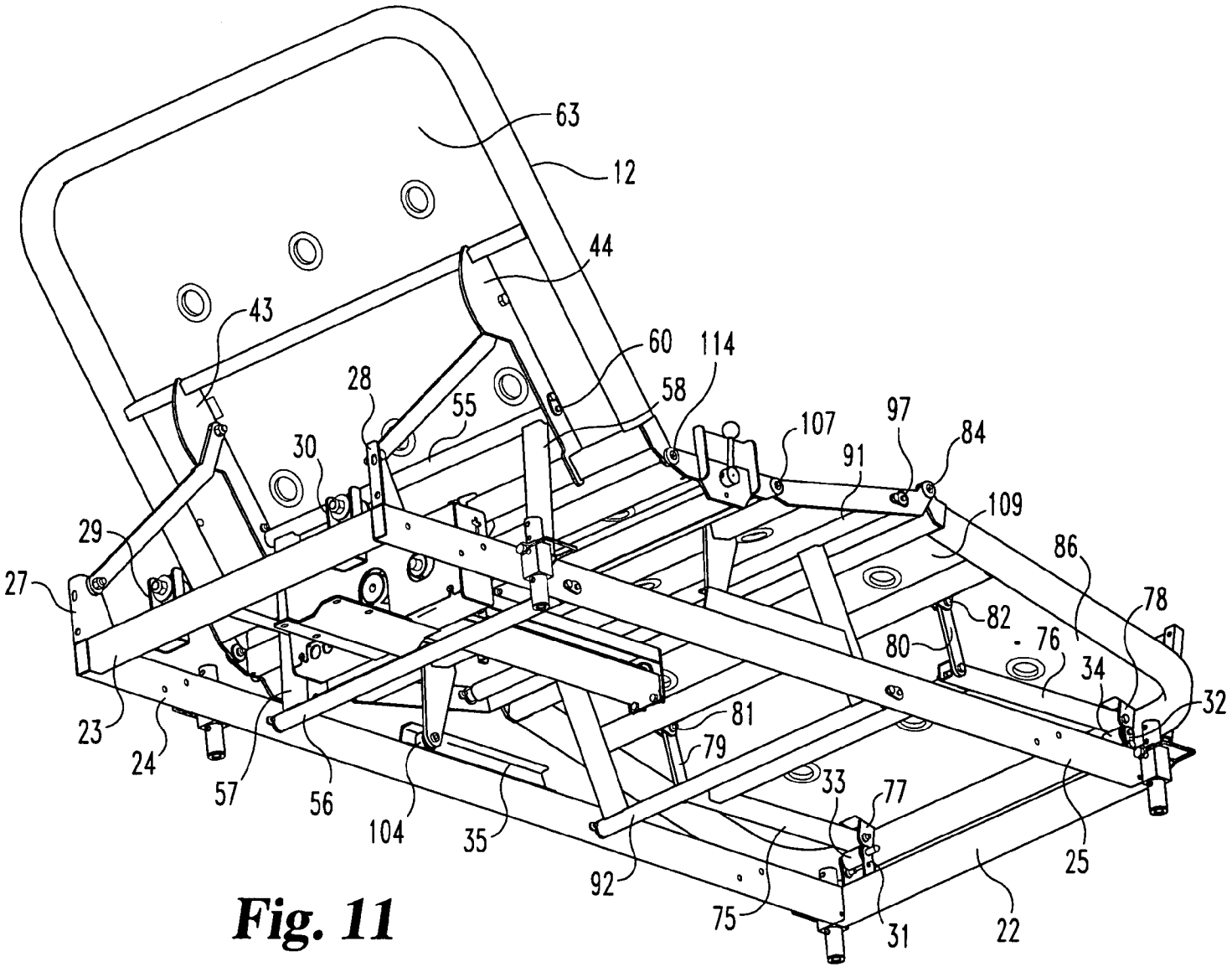
FIG. 11 is a bottom, perspective view of the articulating bed frame 10 of FIG. 1.

Referring to FIGS. 9-11, main frame 11 is a generally rectangular frame of tubular metal construction having opposing front and rear rails 22 and 23, opposing side rails 24 and 25, a pair of rear, upstanding linkage brackets 27 and 28, a pair of rear, drive mounting brackets 29 and 30, and a pair of front, roller mounting brackets 31 and 32. Roller mounting brackets 31 and 32 rotatably hold rollers 33 and 34. A pair of opposing, C-shaped roller channels 35 and 36 are mounted atop side rails 24 and 25, respectively, about midway between front and rear rails 22 and 23.

Back section 12 is a generally rectangular frame of tubular metal construction and includes upper, middle and lower crossbars 38, 39 and 40 extending between opposing side arms 41 and 42, respectively. A pair of pivot head braces 43 and 44 extend rigidly between middle and lower crossbars 39 and 40, and braces 43 and 44 are spaced inwardly from side arms 41 and 42, respectively. First and second linkage assemblies 47 and 48 connect back section 12 with main frame 11. First linkage assembly 47 includes a pair of linkages 49 and 50, which are pivotally connected at their upper ends at pins 51 and 52, respectively, to an upper region of braces 43 and 44, as shown. Linkages 49 and 50 are pivotally connected at their opposing, lower ends to linkage brackets 27 and 28 by pins 53 and 54, respectively. Second linkage assembly 48 includes upper and lower pivot tubes 55 and 56 that are rigidly connected to each other by a pair of opposing connector tubes 57 and 58. Upper pivot tube 55 is pivotally connected to, between and at the lower portions of braces 43 and 44 by appropriate means such as pins 59 and 60. Lower pivot tube 56 is pivotally connected to and between the side rails 24 and 25 of main frame 11 by appropriate means such as pins 61 and 62. Main frame 11, back section 12 and linkage assemblies 47 and 48 thus form a closed quadrilateral linkage assembly that is limited to articulate between the fully reclined position 5 of FIG. 3 and the fully inclined position 7 shown in FIG. 7.

A back section cover plate 63 is fixedly secured to and atop crossbars 38, 39 and 40 and side arms 41 and 42, cover plate 63 providing additional structural support for back section 12. A plurality of holes with grommets 64 are provided in cover plate 63 for ventilation.

Figure 2:
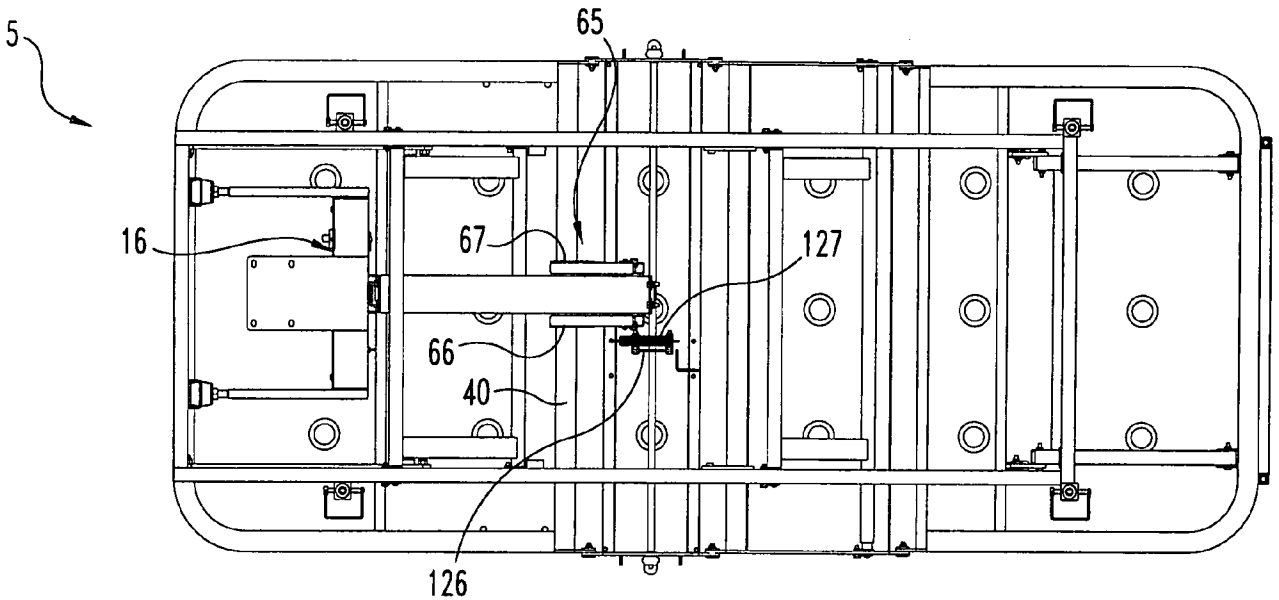
FIG. 2 is a bottom view of the articulating bed frame 10 of FIG. 1 and shown in the fully reclined position 5.

Also connected with back section 12 is a first drive linkage assembly 65 (FIGS. 2 and 9). Assembly 65 includes a pair of drive links 66 and 67 that are rigidly mounted to lower crossbar 40 of back section 12 and extend downwardly therefrom for connection with the drive assembly 16 as will be described herein.

Like back section 12, lower leg section 15 is a generally rectangular frame of tubular metal construction and includes upper, middle and lower crossbars 70, 71 and 72 extending between opposing side rails 73 and 74, respectively. A pair of roller bars 75 and 76 are connected at their forward ends to connector brackets 77 and 78, which are fixedly connected to lower crossbar 72. At their rearward ends, roller bars 75 and 76 are connected to the lower ends of hanger links 79 and 80. Links 79 and 80 are connected at their upper ends to connector brackets 81 and 82, which are connected to middle crossbar 71. Forwardly, lower leg section 15, and more particularly, roller bars 75 and 76, ride upon rollers 33 and 34. Roller bars 75 and 76, hanger links 79 and 80 and rollers 33 and 34 together form a track and guide assembly 85. Alternative embodiments are contemplated wherein track and guide assembly 85 includes low friction slides instead of rollers 33 and 34 to permit roller bars 75 and 76 to slide thereon. Alternatively, rollers or sliding elements are contemplated to be mounted to lower leg section 15 with track members mounted to or made as a part of main frame 11. Other embodiments contemplate any suitable complementary track and guide arrangement to permit lower leg section 15 to ride along the forward end of main frame 11 either freely (as shown in herein) or with some releasable restriction to permit lower leg section to be easily folded over at axis 21 for transport, as described herein. Rearwardly, lower leg section 15 is pivotally connected to upper leg section 14 by pins 83 and 84. As with cover plate 63, a lower section cover plate 86 with holes and grommets 64 is fixedly secured to crossbars 71 and 72 and side rails 73 and 74.

Upper leg section 14 comprises a rear crossbar 87 extending between opposing side rails 88 and 89, respectively. A third linkage assembly 90 connects the front end of upper leg section 14 to main frame 11 and includes upper and lower pivot tubes 91 an 92 that are rigidly connected to each other by a pair of opposing connector tubes 94 and 95. Upper pivot tube 91 is pivotally connected to and between side rails 88 and 89 by pins 96 and 97, respectively. Lower pivot tube 92 is pivotally connected to and between main frame side rails 24 and 25 by pins 98 and 99, respectively. A support link assembly 101 includes a pair of opposing support links 102 and 103 that are rigidly connected to and extend downwardly from rear crossbar 87. At the bottom of each support link 102 and 103 is rotatably connected a roller (one shown at 104), each roller being received to ride within a corresponding one of roller channels 35 and 36. In the present embodiment, roller channels 35 and 36 are straight, which produces substantially straight movement for the lower ends of links 102 and 103. Alternative embodiments are contemplated wherein roller channels 35 and 36 are at least partially non-linear to produce an alternative path for the seat and upper leg sections 13 and 14, as desired. Rearwardly, upper leg section 14 is pivotally connected to seat section 13 by pins 106 and 107, respectively. An upper leg section cover plate 109 has a generally C-shaped cross-section and is fixedly secured to crossbar 87 and side rails 89 and 90 by appropriate means such as welding.

Figure 12:
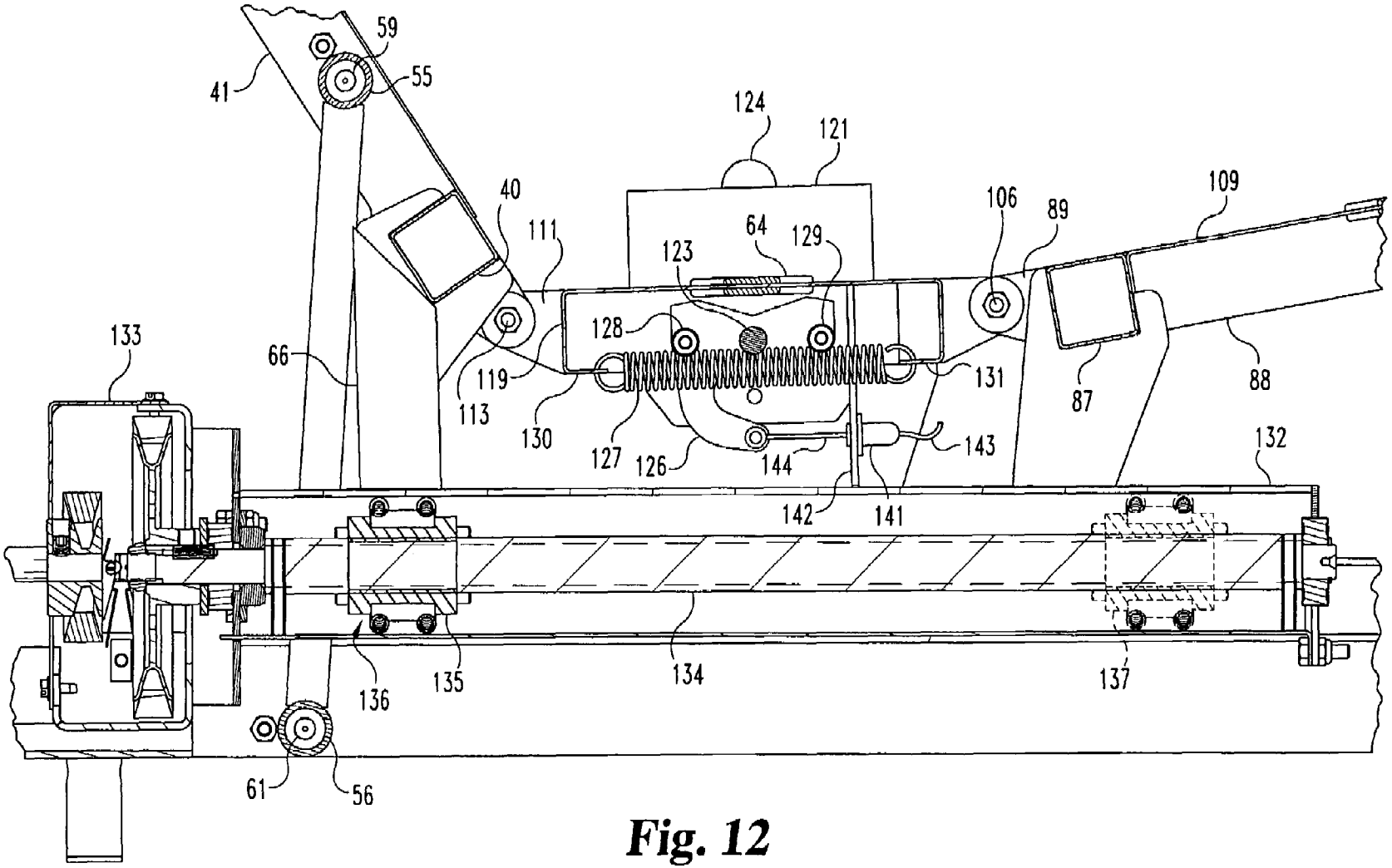
FIG. 12 is an enlarged, side view of the central portion of articulating bed frame 10 of FIG. 9.

Referring to FIGS. 9, 10 and 12, seat section 13 generally comprises opposing side rails 111 and 112 that are pivotally connected at their front ends by pins 106 and 107 to upper leg section side rails 88 and 89, respectively. At their rear ends, seat section side rails 111 and 112 are pivotally connected by pins 113 and 114 to the forward ends of back section side rails 41 and 42, respectively. A seat section plate 119 with holes and grommets 64 and a generally C-shaped cross-section is fixedly secured to side rails 111 and 112 by appropriate means such as welding. Plate 119, in addition to providing a seat surface, also provides additional structural support for seat section 13.

Referring to FIGS. 10 and 12, a drive actuator assembly 120 is connected with seat section 13. Drive actuator assembly 120 includes backing plates 121 and 122, rod 123, handles 124 and 125, C-shaped connection plate 126, and a spring 127. Backing plates 121 and 122 are secured to the outsides of side rails 111 and 112. Rod 123 extends between side rails 111 and 112, through holes in side rails 111 and 112 and plates 121 and 122, and outwardly of plates 121 and 122. Handles 124 and 125 are fixedly secured to the opposing, outwardly extending ends of rod 123, as shown. Connection plate 126 is generally C-shaped and is fixedly secured to rod 123 roughly midway between side rails 111 and 112. Rear and front bumpers 128 and 129 are fixed to the right side of connection plate 126, roughly in line with rod 123, as shown in FIG. 12. Seat plate 119 includes flanges 130 and 131 that extend inwardly toward each other and along the width of plate 119, and spring 127 is stretched between and secured to flanges 130 and 131 to rest just below rod 123 and bumpers 128 and 129, as shown. By pulling or pushing either handle 124 or 125, handles 124 and 125, rod 123 and connection plate 126 all rotate as a unit about the axis of rod 123. Such rotation causes bumpers 128 and 129 to press down against spring 127, and drive actuator assembly 120 is thus biased to stay in the neutral position shown in FIG. 12.

Drive assembly 16 includes any apparatus suitable for providing linear motion to drive links 66 and 67 of drive linkage assembly 65. In the embodiment of FIGS. 1-13, drive assembly 16 includes a worm gear assembly 132 and a gear reduction box 133. Worm gear assembly 132 includes a threaded shaft or "worm" 134 and a follower nut 135 that is driven by the rotation of worm 134 between a rearward position (shown at 136, FIG. 12) and a forward position (shown in phantom at 137). A motor (not shown) is mounted to support plate 138 and, through gear reduction box 133, drives worm 134. Drive links 66 and 67 are connected at their lower ends to follower nut 135 (a first connection end of drive assembly 16) by appropriate means such as thumb screws (one of two screws on opposing sides of worm gear assembly 132 shown at 146 in FIG. 5). Drive assembly 16 is supported at its rearward end (a second connection end of drive assembly 16) by support rods 139 and 140, which are each connected at one end to gear reduction box 133 and at the opposite end to a corresponding drive mounting bracket 29 and 30, respectively. The rotating movement of connection plate 126 controls the operation of drive assembly 16 through connection with a transducer 141 that is supported by a mounting bracket 142 extending down from seat section plate 119. A connection element 144 transmits the motion of connection plate 126 to transducer 141, and the transducer output is relayed to gear reduction box 133 by a suitable cable 143 where it governs the operation of the motor and gear reduction box 133.

In operation from the fully inclined position 7 (FIGS. 8-12), pulling either handle 124 or 125 rotates rod 123 and connection plate 126 which, through transducer 141, actuates drive assembly 16 to rotate worm 134 and move follower nut 135 and the drive links 66 and 67 forwardly. Bed frame sections 12-15 thereby move relative to each other and main frame 11 toward the fully reclined position 5 until either handles 124 and 125 are released or until bed frame 10 reaches the fully reclined position 5. If handles 124 and 125 are released before reaching the fully reclined position 5, spring 127 biases drive actuator assembly 120 back to the neutral position whereupon drive assembly 16 is switched off. Alternatively, should handles 124 or 125 be held in rearwardly rotated positions, whereby worm 134 continues to be forced to rotate, follower nut 135 is constructed such that it will stop moving once a physical limit is reached, either because bed frame sections 12-15 are physically unable to articulate any farther, or because a physical element associated with worm gear assembly 132 precludes further translation of follower nut 135 along worm 134. This removes the possibility of damaging the bed frame elements, particularly the drive assembly 16 and motor (not shown). Reversing the handle input (i.e. now pushing the handles 124 and 125 forwardly) actuates drive assembly 16 in the opposite direction, and bed frame 10 is articulated toward the fully inclined position 7. The same limiting elements are provided for limiting movement of follower nut 135 beyond a predefined extreme relating to the fully inclined position 7. Alternative embodiments are contemplated wherein the travel limit of follower nut 135 is defined by an electronic, optical audio or similar sensor of any appropriate type that senses the position of follower nut 135 and electronically and/or mechanically stops the rotation of worm 134 and/or the translation of follower nut 135.

Of particular importance in the configuration and assembly of bed frame 10 is the location of upper crossbar 38 of back section 12 relative to the rear rail 23 of main frame 11. As bed frame 11 is articulated between the fully reclined and fully inclined positions, the rearward end of back section 12 (which is upper crossbar 38) stays substantially vertically aligned with the rear end of main frame 11 (which is rear rail 23). Bed frame 10 thus exhibits a significant wall-hugging feature whereby, during articulation toward the fully inclined position (FIG. 7), the forward end of back section 12 (lower cross bar 40) is drawn rearwardly, while the rearward end (upper crossbar 38) moves very little horizontally. In relative terms, during articulation from the fully reclined to the fully inclined position, the rearward end (38) of back section 12 is desired to move horizontally forward about 25% or less of what the forward end (40) of back section 12 moves horizontally rearward. Consequently, a person lying on bed frame 10 will remain in substantially the same horizontal position relative to a bed table or cabinet that is typically located to one side and at the head of the bed. As used herein, the fully inclined and reclined positions are meant to include this wall-hugging feature whereby the rearward end of back section 12 (here, upper crossbar 38) stays substantially vertically aligned with the rearward end of bed frame 10 (here, rear rail 23), as shown in FIGS. 2-7. In practice, it may be desirable for the rearward end (38) to move at least slightly forwardly during articulation from the fully reclined position so that the rearward end (38) of back section 12 does not contact any structures that may be protruding from a wall behind the bed, such as a picture or medical equipment or connections therefor.

Alternative embodiments are contemplated wherein the lengths and positionment of the various linkages are modified slightly, the result of which is that, during articulation from the fully reclined to the fully inclined position, the rearward end (38) of back section 12 moves horizontally forward slightly greater than 25% of what the forward end (40) of back section 12 moves horizontally rearward. While the configuration of the present invention permits such adjustment, it is preferred that the ratio of forward movement of the rearward end (38) to the rearward movement of forward end (40) be maintained at about 1 to 4 or less than 1 to 4.

With support link assembly 101 mounted at its bottom end for substantially horizontally linear travel in roller channels 35 and 36, and mounted at its top end proximal to pivot axis 20, and thus substantially adjacent to the forward end of seat section 13, the forward end of seat section 13 moves in a substantially horizontal path. Likewise, the bottom end of first drive linkage assembly 65 moves in a substantially horizontally linear path, and the top end is mounted substantially adjacent to the rear end of seat section 13. Consequently, as bed frame 10 is articulated between the fully reclined and fully inclined positions, seat section 13 remains substantially horizontal. Also, as shown in FIGS. 2-7, the greatest overall length of bed frame 10 occurs in the fully reclined position (FIGS. 2 and 3). As bed frame 10 is articulated toward the fully inclined position, the overall length of bed frame 10 is reduced. In addition, the rearmost extent of bed frame 10 is defined by main frame 11, which does not move during articulation. Therefore, if bed frame 10 is positioned against a wall at the rear or head of the bed frame, articulation of the bed frame will not result in contact of back section 12 with the wall unless the entire bed frame is moved.

An easily removable headboard (not shown) and foot board 149 are provided as desired to maintain the position of a mattress (not shown) that is positioned atop articulating bed frame 10. Side rails (not shown) are also provided in a known manner, as appropriate. Vertically adjustable caster sleeves 148 are connected to main frame 11 and are sized and shaped to receive casters (not shown).

Figure 14:
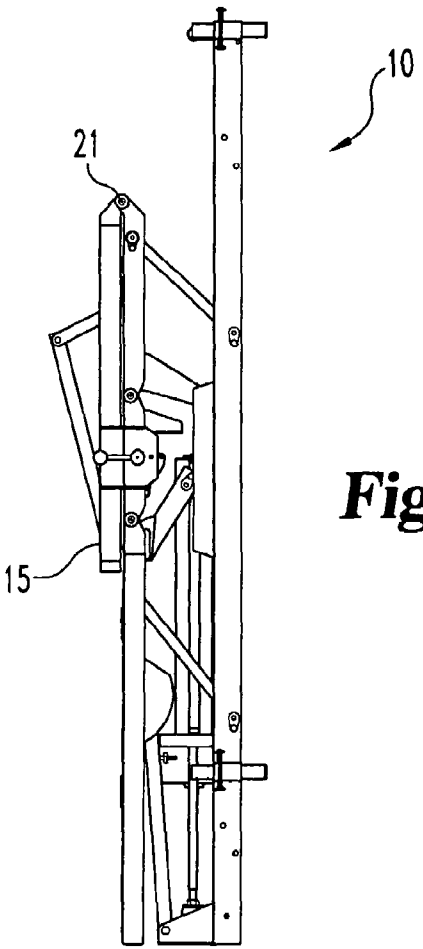
FIG. 14 is a side, elevational of the articulating bed frame 10 of FIG. 13.
Figure 13:
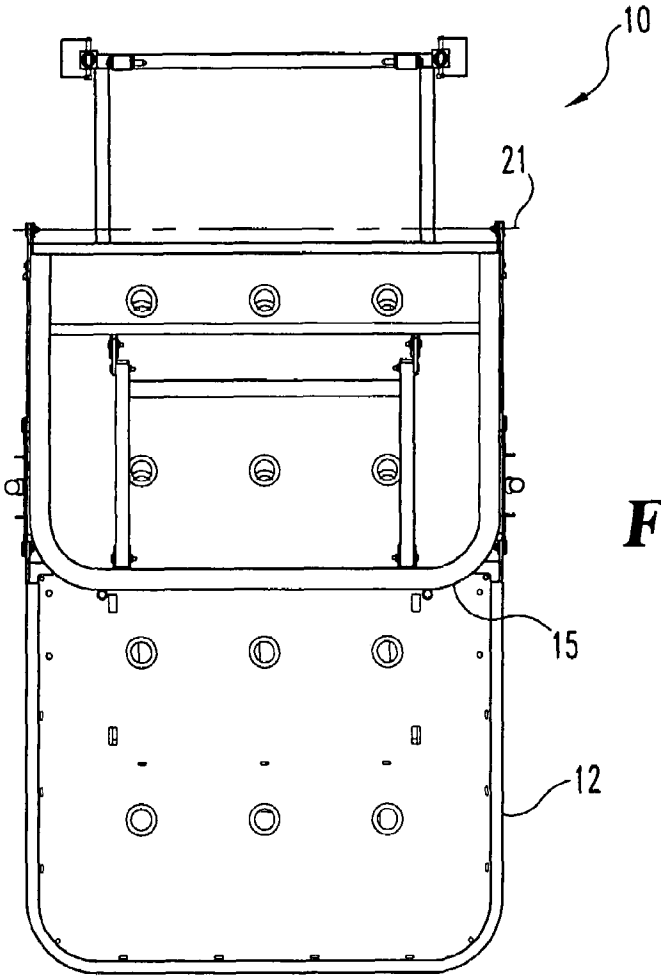
FIG. 13 is a front, elevational view of the articulating bed frame 10 of FIG. 3 and shown in the transport position.

Referring to FIGS. 13 and 14, articulating bed frame 10 can be folded for ease of transport. The transport position is achieved by first removing any headboard or foot board (as necessary), and then by folding lower leg section 15 about 180 degrees from its position in the fully reclined position 5, about axis 21, over and against upper leg section 14 (and seat section 13, depending on the length of lower leg section 15). In the transport position, articulating bed frame 10 is more compact and may be tilted on end, as shown, for movement by hand or with the use of a two-wheel cart or similar device. Alternative embodiments are contemplated wherein lower leg section 15 is folded somewhat less than 180 degrees and to a position not quite against upper leg section 13. While this may be necessary to accommodate some other feature of bed frame 10, such as a particular control apparatus or restraint device, it is preferred that leg frame 15 be able to be folded all the way over and flat against upper leg frame 14 for transport.

Figure 15:
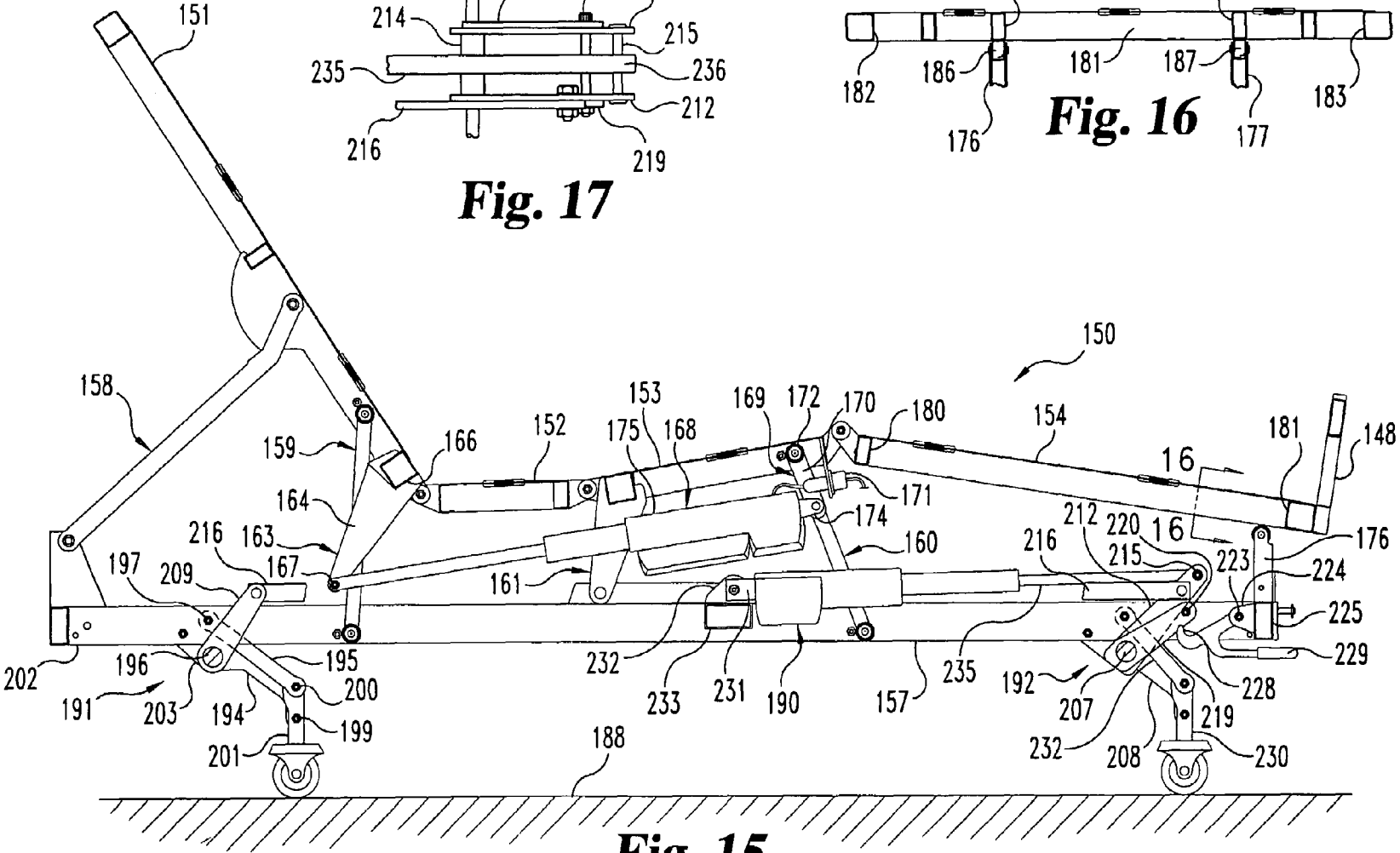
FIG. 15 is side, elevational view of an articulating bed frame 150 in accordance with another embodiment of the present invention.

Referring to FIG. 15 there is shown an articulating bed frame 150 in accordance with an alternative embodiment of the present invention. Like bed frame 10, articulating bed frame 150 includes substantially the same components, such as pivotally interconnected back, seat, upper leg and lower leg sections 151, 152, 153 and 154 that are connected to a main frame 157 by first, second and third linkage assemblies 158, 159 and 160 and support link assembly 161. A first drive linkage assembly 163 includes a pair of drive links (one of two, generally side-by-side links shown at 164) that are each rigidly mounted to lower crossbar 166 of back section 151 and that extends downwardly therefrom for pivotal connection with a first, output end 167 of an articulation drive assembly 168. A second drive linkage assembly 169 includes a pair of drive links (one of two side-by-side links shown at 170) that are each rigidly mounted to upper pivot tube 172 of third linkage assembly 160 and that extends downwardly therefrom for pivotal connection with a second, mounting end 174 of articulation drive assembly 168. Articulation drive assembly 168 is thus essentially pivotally connected to third linkage assembly 160 at point somewhat spaced between upper leg section 153 and main frame 157. Articulation drive assembly 168, like drive assembly 16 of bed frame 10, articulates bed frame 150 between a fully reclined position (like that shown in FIGS. 2 and 3) and a fully inclined position of FIG. 15 (and like that shown in FIGS. 6 and 7), as well as all positions in between. In one embodiment, articulation drive assembly 168 comprises a linear actuator 175 model LA31 from Linak U.S. Inc of Louisville, Ky. Linear actuator 175 has a thrust maximum push of 1349 $lb_f$, a thrust maximum pull of 899 $lb_f$ and a stroke length of up to 11.82 inches. With linear actuator 175 actuated to the extended position, as shown, bed frame 150 is articulated to the fully inclined position. When linear actuator 175 is actuated to the retracted position (not shown), bed frame 150 will be articulated to the fully reclined positioned (like that shown in FIGS. 2 and 3). Actuation of linear actuator 175 is controlled by a user with a suitable keypad or similar device (not shown) electrically connected with linear actuator 175 in a known manner. Power is provided to linear actuator 175 through a standard 110 v wall socket.

Linear actuator 175 may be any device that is connectable at opposing ends between first and second drive linkage assemblies 163 and 169 and operable to pull and push the distal ends of the drive linkage assemblies 163 and 169 together and apart to articulate bed frame 150 between the fully reclined and fully inclined positions described and shown herein.

Figure 16:
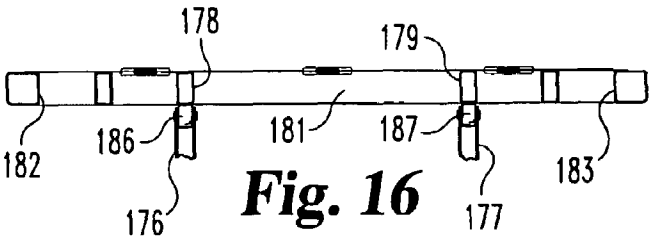
FIG. 16 is a cross-sectional view of the articulating bed frame 150 of FIG. 15 taken along the arrows 16-16, viewed in the direction of the arrows and without foot board 148.

The leg section 154 of bed frame 150 also differs from bed frame 10 in that there are no roller bars 75 and 76 nor hangar links 79 and 80. Instead, front roller mounting brackets 176 and 177 (FIGS. 15 and 16) extend up higher from main frame 157 than roller mounting brackets 31 and 32 of bed frame 10. Also, there is no middle crossbar 71 in the lower leg section, but instead lower leg section 154 includes central rails 178 and 179 that extend between upper and lower crossbars 180 and 181 and are parallel to side rails 182 and 183. Lower leg section 154, and more particularly, central rails 178 and 179, ride upon the raised rollers 186 and 187 of front roller mounting brackets 176 and 177.

Bed frame 150 is also provided with a vertical adjustment apparatus for raising and lowering main frame 157 relative to the ground 188, the apparatus generally including a bed lift drive assembly 190 and four identical castor assemblies, one at each corner of main frame 157 (two shown at 191 and 192). Castor assemblies such as those shown at 191 and 192 are well known and each generally includes a support arm 194 and a control arm 195 pivotally mounted at a proximal end to main frame 157 by separate axles 196 and 197. At their distal ends, each arm 194 and 195 is pivotally mounted at separate pivot points 199 and 200 to a single castor leg 201. This configuration permits castor leg 201 to maintain a constant vertical angle as it rises and falls relative to main frame 157. The pivotal connection of support arm 194 to main frame 157 is achieved by support arm 194 being fixedly connected to axle 196. Axle 196 generally extends between opposing bed frame side rails (one of two opposing and parallel rails shown at 202) and is held for rotation at each such side rail by a bracket (one of two brackets shown at 203) that is fixed to its respective side rail (202). There are thus two such axles—a rear axle 196 and a front axle 207—extending between the opposing side rails of bed frame 157. Rear axle 196 connects the left, rear support arm 194 of bed lift castor assembly 191 with the right, rear support arm (not shown) of the right, rear castor assembly (not shown), the two rear support arms thus rotating as a unit about the axis of axle 196. Likewise, at the front of bed frame 10, the support arms (one of two shown at 208) of front bed lift castor assemblies (one of two shown at 192) are fixedly tied together to rotate as a unit by and with axle 207.

Figure 17:
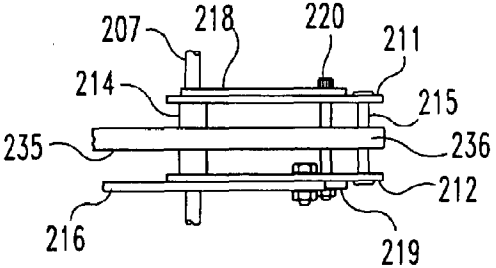
FIG. 17 is a top view of the radial arms 211 and 212 and rocker arms 218 and 219 configuration of the bed frame 150 of FIG. 15.

A radial arm 209 extends rigidly and radially from axle 196, between opposing side rails (one shown at 202). Referring to FIGS. 15 and 17, a pair of radial arms 211 and 212 extend rigidly from a sleeve 214 that is mounted for rotation about front axle 207. A pin 215 is connected to extend between the distal ends of arms 211 and 212. A long connection link 216 is pivotally connected between the distal end of radial arm 209 and arm 212, as shown. A pair of rocker arms 218 and 219 extend rigidly and radially from front axle 207, just outside of radial arms 211 and 212. A limit pin 220 is connected to extend between the distal ends of rocker arms 218 and 219 and on the clockwise side of radial arms 211 and 212, as viewed in FIG. 15. A limit catch 222 is pivotally mounted at pin 223 to a bracket 224, which is fixedly mounted to front rail 225 of main frame 157. Limit catch 222 defines a hook 228 extending generally rearwardly of pin 223 and defines a foot pedal 229 extending generally downwardly and forwardly of pin 223. Limit catch 222 is configured so that depression of foot pedal 229 from the front will pivot limit catch 222 about pin 223, whereby hook 228 will hook up under limit pin 220 and prevent rocker arms 218 and 219 from rotating counterclockwise, as viewed in FIG. 15.

Bed lift drive assembly 190 has a mounting end 231 that is mounted to a bracket 232 that is fixed to a crossbar 233 that extends between the opposing side rails (one shown at 202) of main frame 157. Drive assembly 190 has an output spindle 235 that is operable to extend and retract relative to the mounting end 231, and the distal, output end 236 of spindle 235 is pivotally mounted to pin 215, which is connected to the distal ends of radial arms 211 and 212. In one embodiment, like articulation drive assembly 168, bed lift drive assembly 190 comprises a suitable linear actuator available from Linak U.S. Inc of Louisville, Ky., but may comprise any device capable of extendable and retractable connection between a point on main frame 157 and at least one of radial arms 211 or 212. Actuation of bed lift drive assembly 190 is controlled by a user with a suitable keypad or similar device (not shown) electrically connected with bed lift drive assembly 190 in a known manner.

The operation of the vertical adjustment apparatus of bed frame 150 will now be described. Reference to clockwise and counterclockwise rotations and other movement and positional movements relative to bed frame 150 are as viewed in FIG. 15. In operation and with limit catch in a deactivated position (as shown in FIG. 15), retraction actuation of bed lift drive assembly 190 pulls radial arms 212 and 209 to rotate counterclockwise. Consequently, support arm 194 and control arm 195 rotate about their mounting points at 196 and 197, respectively, and castor leg 201 rises relative to main frame 157. Also, at the front of bed frame 150, radial arms 211 and 212 are caused to rotate counterclockwise. With the axis of front axle 207 being offset from the front castor legs (one of two shown at 230), the weight of bed frame 157 biases axle 207 to rotate counterclockwise, such rotation only limited by limit pin 220 bearing on the clockwise underside of radial arms 211 and 212. As radial arms 211 and 212 rotate counterclockwise about the axis of axle 207, so do rocker arms 218 and 219, and the front castor legs also rise relative to main frame 157, and the front of main frame 157 drops. If limit catch 222 is actuated by depressing foot pedal 229 to cause hook 228 toward engagement with limit pin 220, when radial arms 211 and 212 rotate counterclockwise, rocker arms 218 and 219 rotate with them until hook 228 engages limit pin 220. Then rocker arms 218 and 219 are prevented from rotating counterclockwise any further. Radial arms 211 and 212 can continue to rotate (via drive assembly 190) and, consequently, only the rear portion of bed frame 157 is lowered.

Extension actuation of bed lift drive assembly 190 rotates all of radial arms 209, 211 and 212 clockwise. If limit catch 222 was not engaged, both the front and rear portions of main frame 157 will rise equally. If limit catch 222 was engaged, the front will begin to raise as soon as radial arms 211 and 212 rotate clockwise to engage limit pin 220 at which point rocker arms will be rotated clockwise, as well, which will move limit pin out of engagement with hook 228. Limit catch 222 is configured and mounted to bracket 224 to be biased toward a rest position, disengaged from limit pin 220 (as shown in FIG. 15) until it is depressed and held by foot pedal 229.

Figure 18:
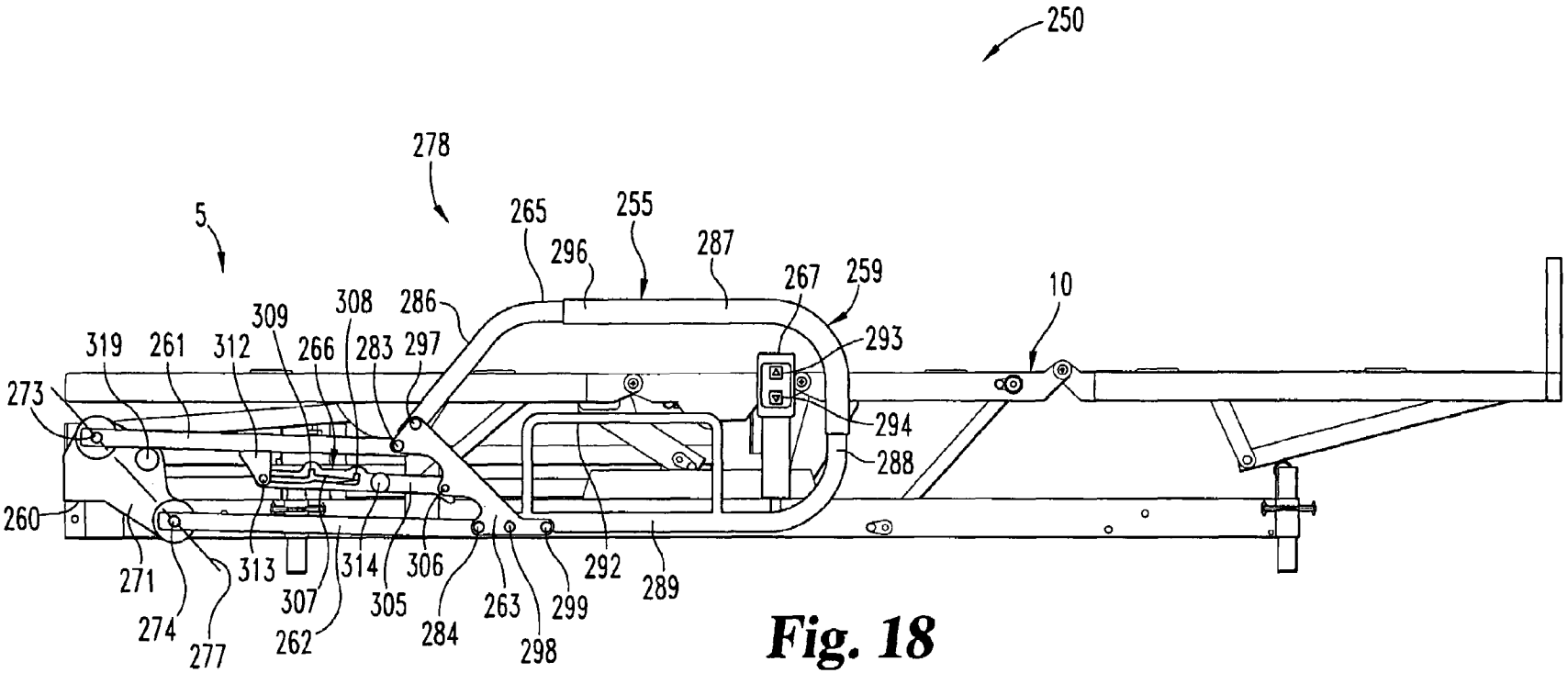
FIG. 18 is a side, elevational view of an articulating bed frame 250 in accordance another embodiment of the present invention, with bed frame 10 shown in the fully reclined position 5 and side rail assembly 255 shown in the down position 278.
Figure 19:
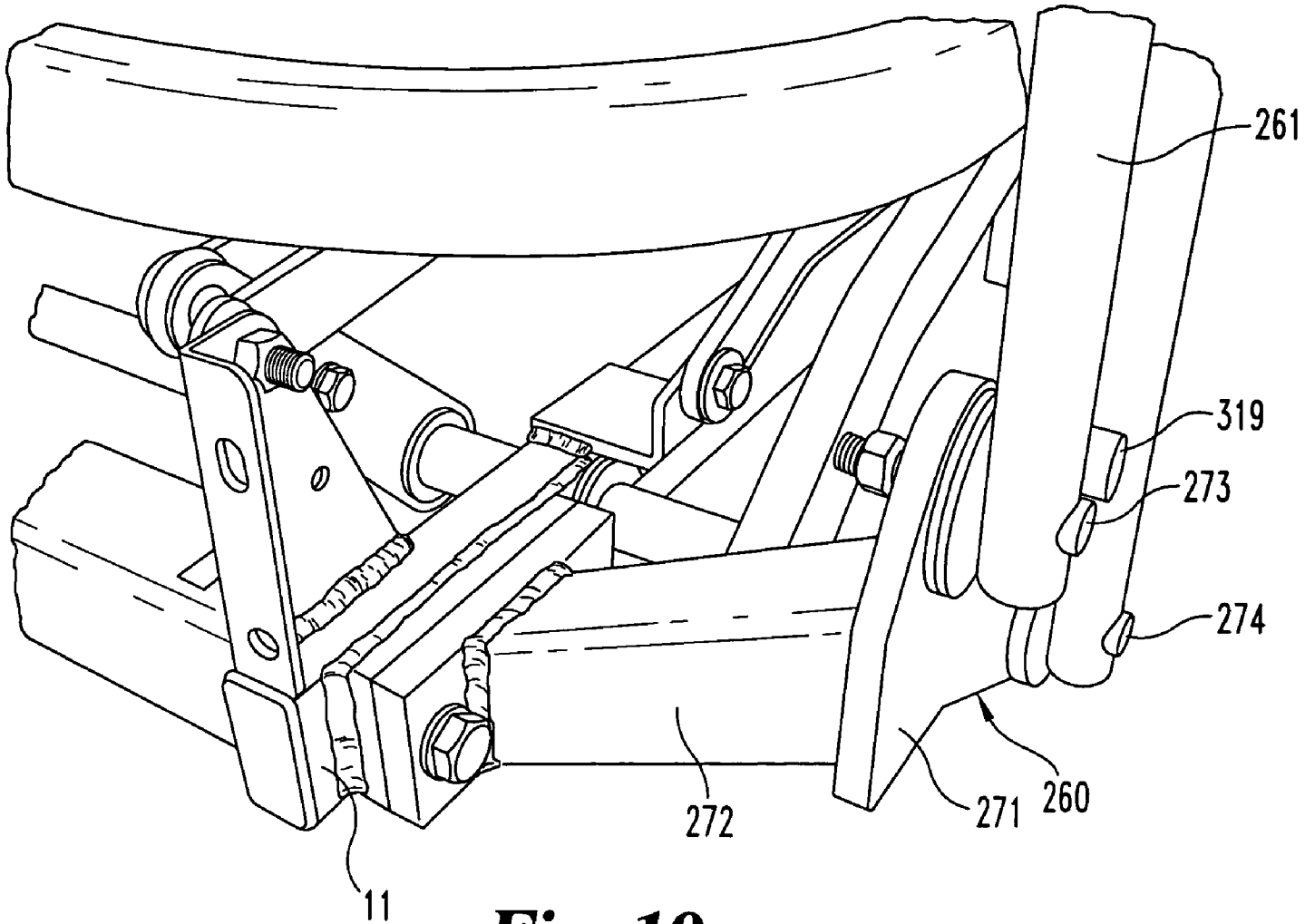
FIG. 19 is a perspective view of the lower portion of side rail assembly 255 of FIG. 18, showing mounting bracket 260 of bed frame 250 as mounted to main frame 11.
Figure 20:
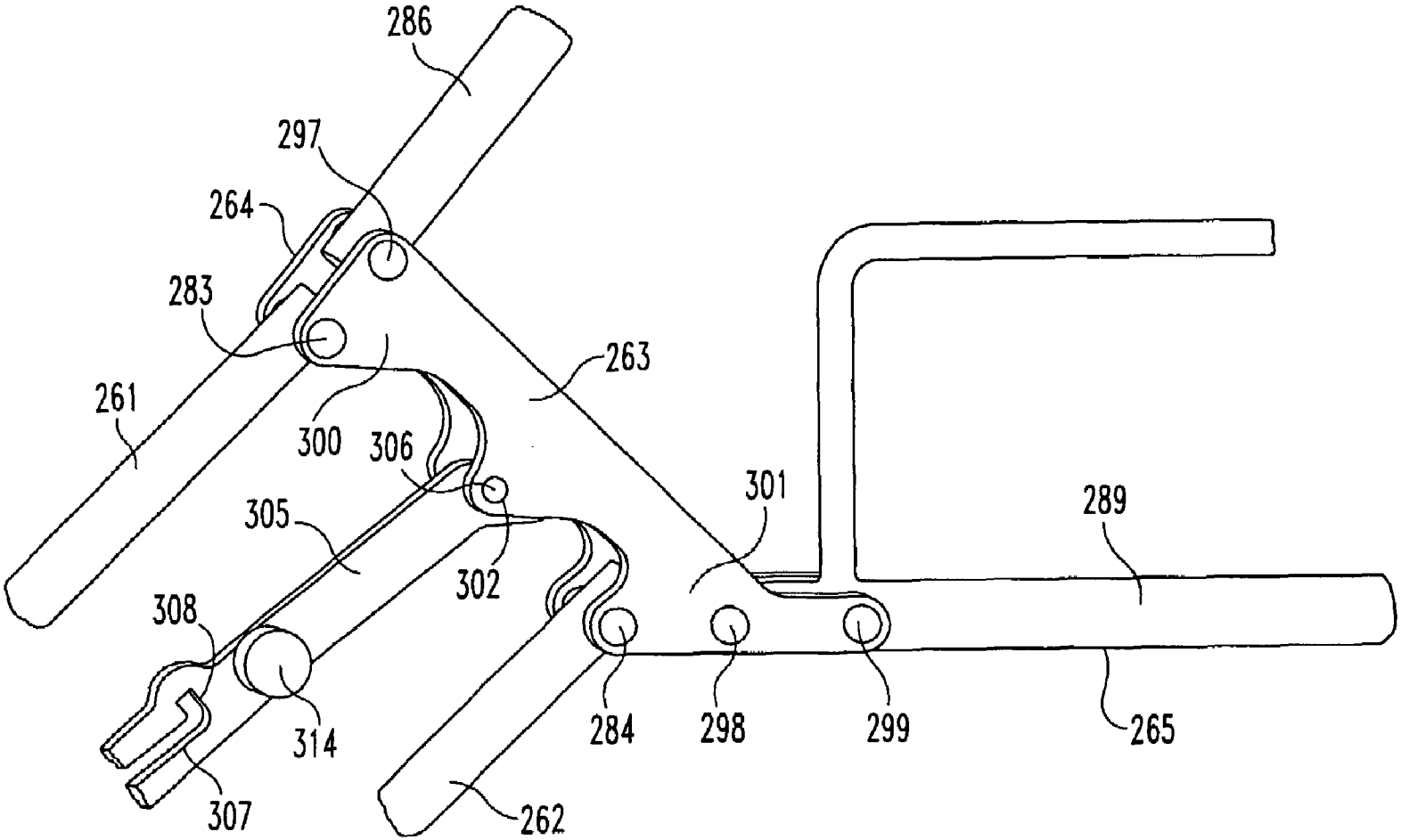
FIG. 20 is a perspective view of the central portion of side rail assembly 255 of FIG. 18, showing connector brackets 263 and 264.

Referring to FIGS. 18-20, there is shown an articulating bed frame 250 in accordance with one embodiment of the present invention. Bed frame 250 comprises the bed frame 10 of FIGS. 1-14 along with an articulating side rail assembly 255. Bed frame 10 of FIGS. 1-14 has been thoroughly described herein and like reference numbers will be used, as necessary, for the common parts of bed frame 10 in bed frame 250. Side rail assembly 255 includes a handle assembly 259, mounting bracket 260, first and second linkage arms 261 and 262, side rail position control assembly 266 and control unit 267. Handle assembly 259 includes connector brackets 263 and 264 and a handle 265. As shown in FIG. 19, mounting bracket 260 includes a mounting plate 271 and a mounting tube 272 that rigidly connects plate 271 to the side and at the rear end of the main frame 11 of bed frame 10. Tube 272 extends outwardly of main frame 11 at a slight incline to ensure sufficient clearance for linkage arms 261 and 262 when bed frame 10 is lowered to its fully reclined position 5.

Linkage arms 261 and 262 are each freely, pivotally connected at one end to mounting plate 271 by pins 273 and 274, which constitutes first and second pivot axes, respectively. As with any of the "pins" referred to herein for pivotal connection of one element to another, such pin is contemplated to comprise any appropriate means that securely permits relative pivotal movement between the connected elements including, but not limited to some combination of bolts, nuts, washers, wear rings, rivets, pins, and/or lock rings. The mounting of linkage arms 261 and 262 to mounting plate 271 is such that the pivot axes of pins 273 and 274 are spaced apart and along a line 277 that is preferably at between about 40° and 50° to horizontal, which arrangement provides sufficient clearance and range for side rail assembly 255 to pivot between its down position 278 (FIG. 18) and up position 279 (FIG. 25), as described herein. At their upper ends, linkage arms 261 and 262 are freely, pivotably connected to connector brackets 263 and 264, as shown, by pins 283 and 284, which constitutes third and fourth pivot axes, respectively. Connector brackets 263 and 264 are substantially identical and sandwich linkage arms 261 and 262 therebetween (FIG. 20).

Handle 265 is a generally C-shaped tubular member with angled, top, front and bottom sections 286, 287, 288 and 289, respectively. A generally C-shaped auxiliary handle 292 is rigidly connected to and extends upwardly from bottom section 289, as shown. Likewise, control unit 267 is rigidly connected to and extends upwardly from bottom section 289, as shown. Control unit 267 replaces the drive actuator assembly 120 of bed frame 10 and electronically connects with and controls drive assembly 16 or any similar suitable device employed for articulating bed frame 10 between its fully reclined and fully inclined positions. Control unit 267 includes at least two buttons 293 (incline) and 294 (recline). Auxiliary handle 292 extends up toward top section 287, but is sufficiently spaced down from top section 287 to enable a person on bed frame 250 to easily reach between auxiliary handle 292 and top section 287 and access control unit 267 which, concordantly, extends up from bottom section 289 enough to position buttons 293 and 294 generally in alignment with the gap between top section 287 and auxiliary handle 292. Further, because control unit 267 and auxiliary handle 292 are connected only with bottom section 289, a person gripping side rail assembly 255 can grasp handle 265 at generally any position along angle, top or front sections 286, 287 or 288 without encountering another structural element connected thereto. That is, such person can wrap his hand completely around the tubular rail and can easily slide it along angle, top and front sections 286, 287 and 288, unimpeded by a structural bar that, for example, might tee into top section 287.

Because handle 265 is generally C-shaped, a friction grip 296 of rubber or similar grip-friendly material can be slid on from the angled section end and into position covering much of top section 287 and front section 288. Grip 296 may be smooth, ribbed or of any desired surface configuration or material to provide a comfortable and grip-enhancing surface for the bed user. Grip 296 may be sized longer or shorter than shown in FIG. 18, as desired.

Handle 265 is immovably connected at the inboard ends of its angle section 286 and bottom section 289 to connector brackets 263 and 264 at upper pin 297 and lower pins 298 and 299, with such inboard ends of angled section 286 and bottom section 289 being sandwiched between brackets 263 and 264 (FIG. 20). Handle 265 and connector brackets 263 and 264 thus constitute handle assembly 259, which moves as a unit and in a substantially constant horizontal orientation between the down and up positions 278 and 279, respectively. Connector brackets 263 and 264 (identical to each other) are shaped as shown in FIG. 20 with holes at one end 300 for pins 283 and 297 and at their opposite ends 301 for pins 284, 298 and 299. Holes are defined in brackets 263 and 264 midway between ends 300 and 301 (as at 302) for pivoting connection to the set link 305 of side rail position control assembly 266, as described herein.

Side rail position control assembly 266 includes a set link 305 pivotally connected at one end by a pin 306 to and sandwiched between brackets 263 and 264. At its opposite end, set link 305 defines a closed-ended slot 307 with two notches 308 and 309. Notch 308 is at the inboard end of slot 307. There is no notch at the outboard end 310 (FIG. 22) of slot 307, and notch 309 is midway between notch 308 and outboard end 310. The length of slot 307 and relative positionment of the slots (308 and 309 and/or other slots that may be desired) defines the set positions of side rail assembly 255, as described herein. A guide arm 312 extends from linkage arm 261 to hold a set pin 313 that extends into and follows within slot 307. A knob 314 is provided on set link 305 to enable and facilitate manual engagement and disengagement of position control assembly 266.

Figure 21:
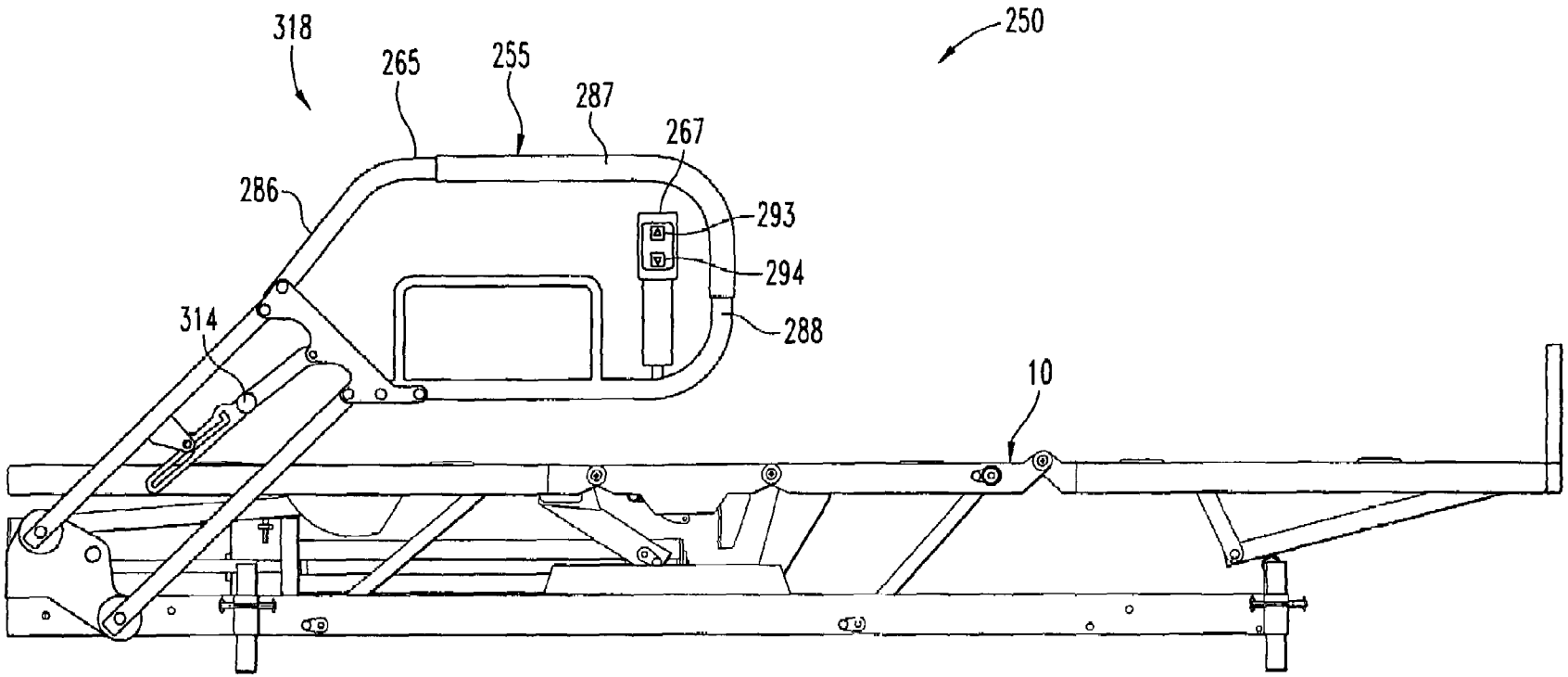
FIG. 21 is a side, elevational view of articulating bed frame 250 of FIG. 18, with bed frame 10 shown in the fully reclined position 5 and side rail assembly 255 shown in the intermediate position 318.
Figure 22:
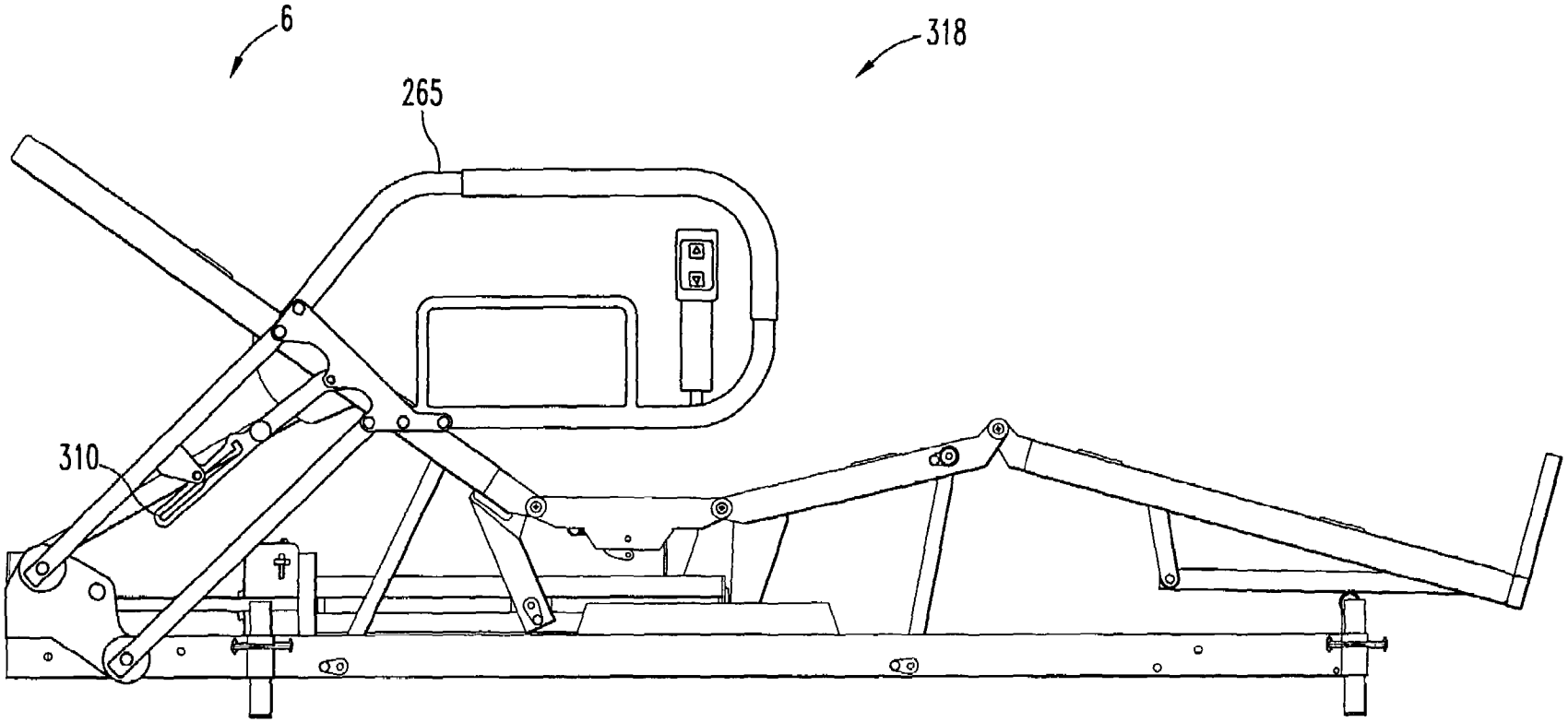
FIG. 22 is a side, elevational view of articulating bed frame 250 of FIG. 18, with bed frame 10 shown in the intermediate position 6 and side rail assembly 255 shown in the intermediate position 318.
Figure 23:
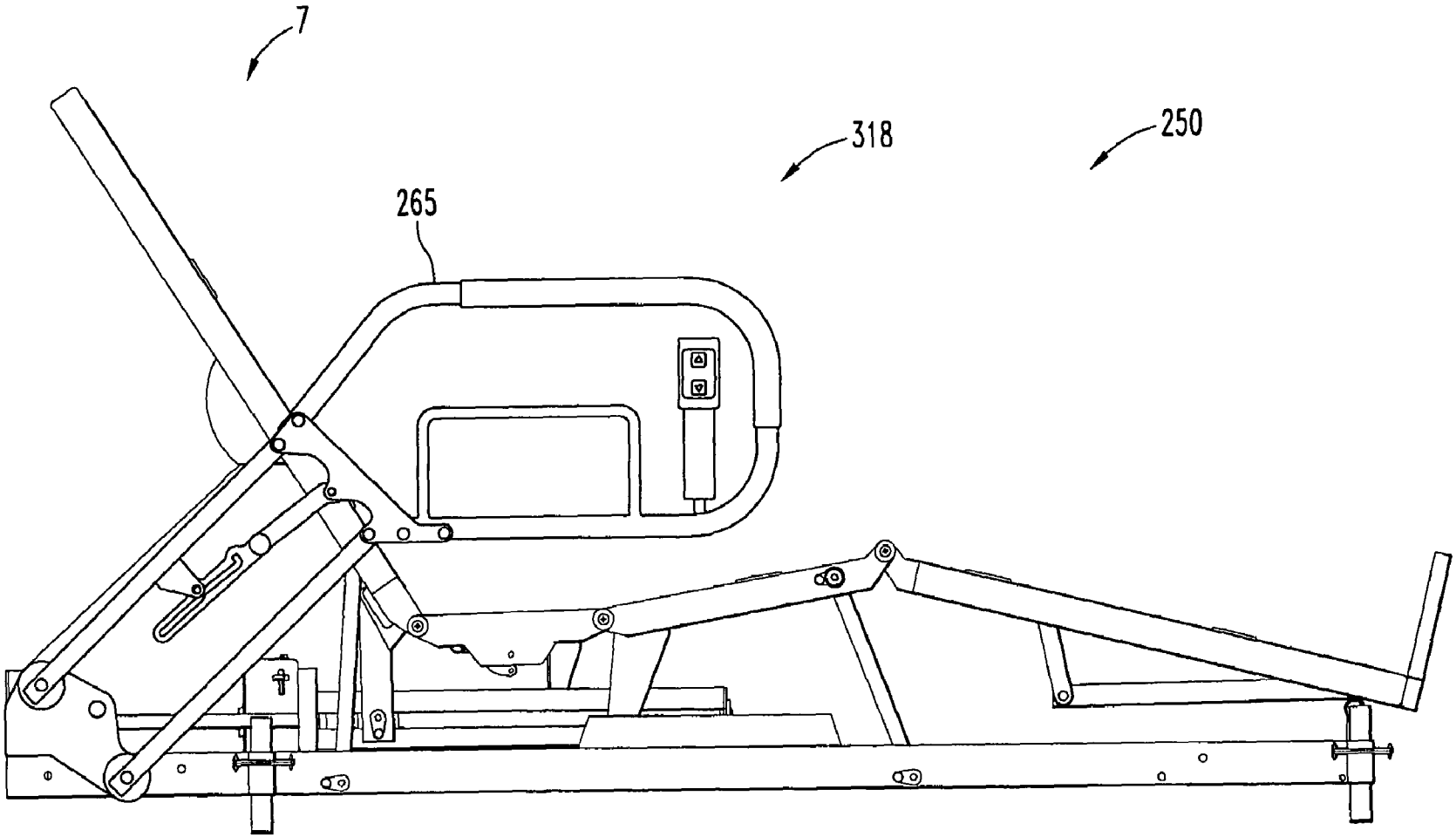
FIG. 23 is a side, elevational view of articulating bed frame 250 of FIG. 18, with bed frame 10 shown in the fully inclined position 7 and side rail assembly 255 shown in the intermediate position 318.
Figure 24:
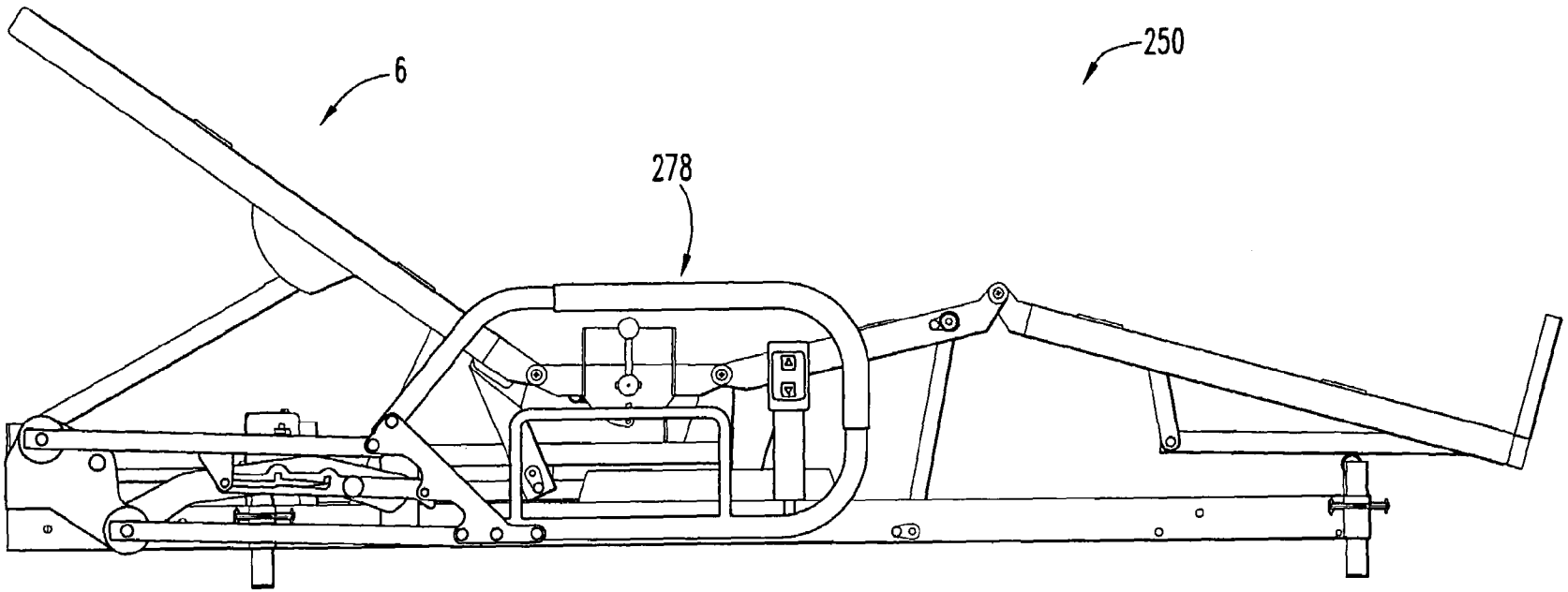
FIG. 24 is a side, elevational view of articulating bed frame 250 of FIG. 18, with bed frame 10 shown in the intermediate position 6 and side rail assembly 255 shown in the down position 278.
Figure 25:
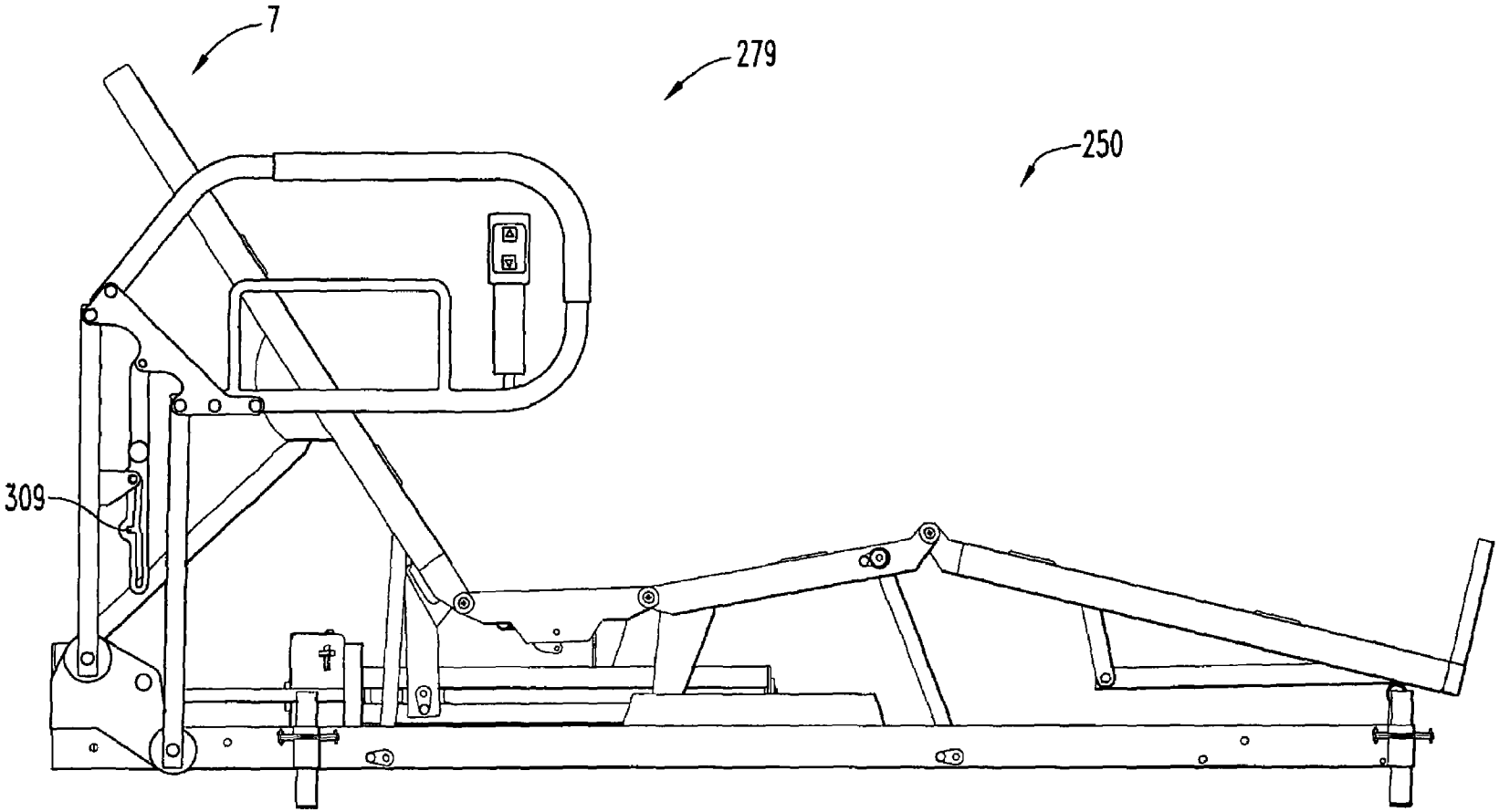
FIG. 25 is a side, elevational view of articulating bed frame 250 of FIG. 18, with bed frame 10 shown in the fully inclined position 7 and side rail assembly 255 shown in the up position 279.

In operation, from the down position 278 (FIG. 18), handle 265 may be grasped and lifted upwardly, whereby side rail assembly 255 will pivot at pins 273 and 274 relative to main frame 11 and articulate toward up position 279 (FIG. 25). Before reaching the up position 279, set pin 313 will drop into middle notch 309, and side rail assembly 255 will be releasably locked in an intermediate position 318 (FIGS. 21-23). To articulate side rail assembly 255 to the full up position 279, knob 314 is grasped and lifted, thereby pivoting set link 305 about pin 306 and causing set pin 313 to drop out of slot 307. Handle 265 can then be lifted to the full up position 279, whereby set pin 313 will drop into inboard notch 308 and lock side rail assembly 255 in the full up position 279 (FIG. 25). It is noted that the full down position 278 of side rail assembly 255 is defined by the position of the outboard end 310 of slot 307 (that is, the end of slot 307 farthest from the attachment of link 305 at pin 306). Thus, when set pin 313 reaches the outboard end 310 of slot 307, side rail assembly 255 cannot articulate any farther down. Likewise, the inboard end of slot 307 at notch 308 defines the upper limit of articulation of side rail assembly 255. The shape of slot 307, that is, its length and any notches or other deviations from a straight configuration, defines the movement of set link 305 as side rail assembly 255 is articulated and primarily defines the releasable locking positions for side rail assembly 255. As such, the term notches, as used herein, is contemplated to include such other deviations in slot 307 from a straight configuration that might be used to provide variable releasably locking positions. It is also noted that, to the extent pin 313 reaches the outboard end 310 of slot 307 and defines or contributes to limiting further downward movement of handle assembly 259, side rail assembly 255 is considered there to be releasably locked in the down position 278, it being held there by gravity. A pivot stop 319 rigidly extends outwardly from mounting plate 271 and is juxtaposed relative to the pivot axis of pin 273 and the diameter of linkage arm 261 so that when set pin 313 engages outboard end 310 of slot 307, linkage arm 261 engages stop 319, the latter also preventing any further clockwise rotation of linkage arm 261 about pin 273 (as viewed in FIG. 18). Stop 319 thus provides additional stability and support for side rail assembly 255 at its down position 278 in view of significant downwardly directed user forces that may be applied to side rail assembly 255.

As described with reference to bed frame 10 of FIGS. 1-14, the bed sections and linkage assemblies are sized, shaped and connected so that, upon articulation, a person lying on bed frame 10 (that is, typically on a mattress on bed frame 10) will remain in substantially the same horizontal position relative to a bed table or cabinet typically located to one side and at the head of the bed concordantly, with bed frame 250, with side rail assembly 255 mounted directly to main frame 11 (instead of to any of the articulating bed sections (12-15) or corresponding linkage assemblies), such person will remain in substantially the same horizontal position relative to articulating side rail assembly 255. As shown comparing FIGS. 22 and 23, articulation of bed frame 10 between the intermediate position 6 (FIG. 22) and fully inclined position 7 (FIG. 23), handle 265 remains in substantially the same horizontal position relative to back section 12. Likewise, the sizes, shapes and connections of the components of side rail assembly 255 are designed so that articulation of side rail assembly 255 will cause handle 265 to move in a path whereby connector brackets 263 and 264 stay closely aligned with back section 12. Thus, any two or more set positions for side rail assembly 255 (such as down position 278 and intermediate position 318) will provide relatively the same arm comfort position for the bed user.

Notches 308 and 309 of set link 305 are angled relative to the main, generally linear portion of slot 307 so that set pin 313 will automatically enter and stay in notches 308 and 309 as side rail is articulated between the up and down positions. Entry into notches 308 and 309 will generally be gravity assisted, but alternative embodiments are contemplated wherein an appropriate biasing means is provided to urge set link 305 to rotate counterclockwise (as viewed in FIG. 18) about pin 306, and thus ensure that set pin 313 will automatically enter and stay in a notch 308 or 309 until manually dislodged therefrom. Such biasing means includes, but is not limited to springs of various shapes, sizes and configurations such as, but not limited to coil, leaf and helical metal springs or rubber elements, all of such biasing devices being known in the art.

Alternative embodiments are contemplated where set link 305 has more or fewer notches than the two notches 308 and 309 to provide more or less than the three set positions for side rail assembly 255 described herein.

Figure 27:
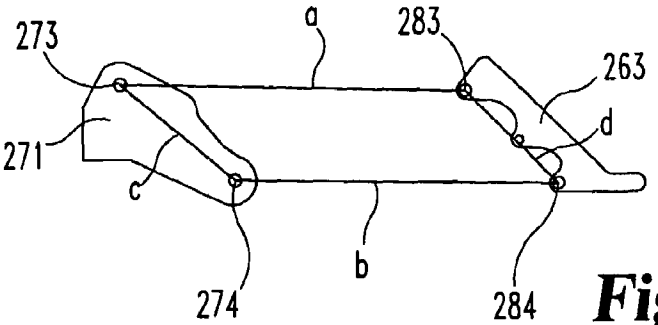
FIGS. 26-30 show alternative embodiments of the linkages a through d of side rail assembly 255.
Figure 26:
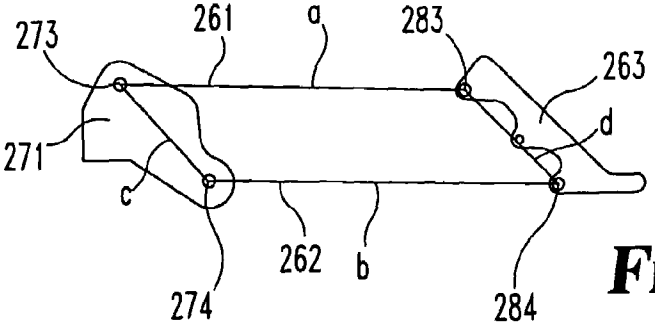
Figure 28:
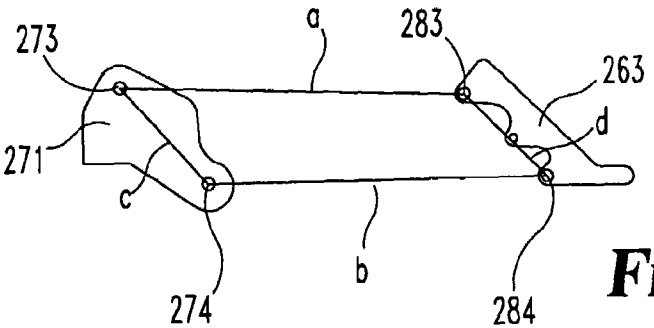
Figure 29:
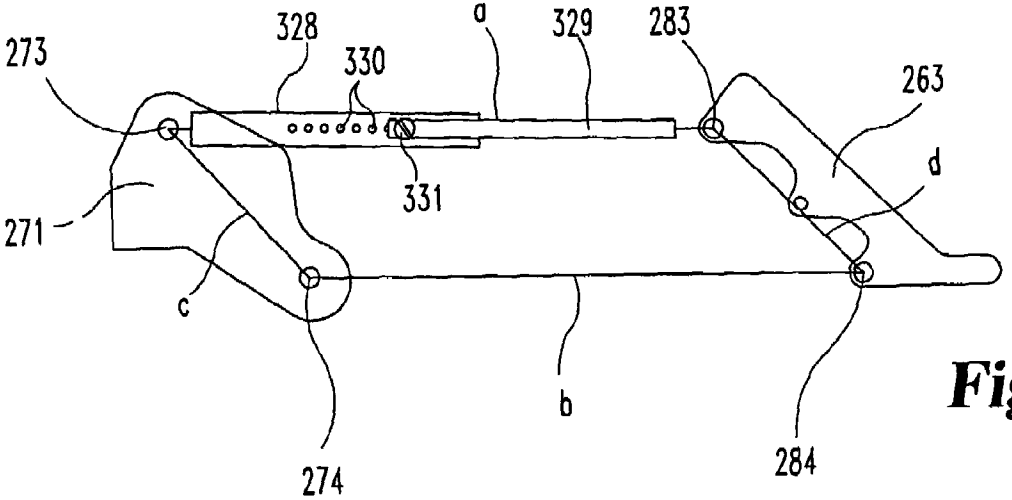

It is noted that linkage arms 261 and 262, brackets 263 and 264 and mounting plate 271 are sized and configured so that pins 273, 274, 283 and 284 generally define a parallelogram. Referring to the diagram of FIG. 26, the connections and relative distances among pins 273, 274, 283 and 284 are represented by lines a through d (linkage arm, 261 linkage arm 262, mounting plate 271 and brackets 263/264, respectively). In the present embodiment, a=b and c=d, and the figure abcd is a parallelogram. Alternative embodiments are contemplated wherein the distances between various pins 273, 274, 283 and 284 vary from that of FIG. 26 or are manually or mechanically variable. For example, either a>b (FIG. 27) or a<b. In either case c may equal d or be greater or less than d. Or, either c>d (FIG. 28) or c<d. In either case a may equal, or be greater or less than b. Other embodiments are contemplated where any one or more of links a, b, c or may be made adjustable. For example, and without limitation, link a may be manually or mechanically adjustable by any appropriate configuration that enables a person to vary the length of link a. One such configuration is shown in FIG. 29 where link a comprises a base plate 328 and a set bar 329. Base plate 328 is pivotally connected at one end to mounting plate 271 by pin 273 and has defined therein a series of spaced apart holes 330 at its opposite end. Set bar is pivotally mounted at its one end to connector brackets 263 and 264 and has a set pin 331 at its opposite end. Set pin 331 can be releasably locked in any one of holes 330 to vary the combined length of base plate 328 and set bar 329, and thus, the length of link a (the distance between pins 273 and 283.)

It is noted that side rail assembly 255 provides mounting at one narrowly dimensioned location near the rear of bed frame 10, and the components of side rail assembly 255 may thus be moved out of the way of other elements of bed frame 10 when side rail assembly 255 is articulated to its up position 279. This is accomplished, in part, because the pivotal mounting points of linkage arms 261 and 262 at pins 273 and 274 are closely spaced together and in the angled configuration, that is, between about 40 degrees and 50 degrees from horizontal. Further, in the down position, handle assembly 259 is entirely lateral of the first and second pivot axes (pins 273 and 274). That is, as viewed in FIG. 18, the left-most portion of handle assembly 259 (roughly pivot pin 283) is entirely to the right of the right-most portion of first and second pivot axes (pins 273 and 274). This configuration further permits handle assembly 259 to move vertically a considerable distance, while achieving a substantially compact down position. This results, in part, because of the ratio between the length of the linkage arms 261 and 262 (lengths a and b) and the span between pivot pins 273 and 274 and between pivot pins 283 and 284 (lengths c and d, respectively). Preferably, both a and b are between 2 and 3 times both c and d, and in one embodiment, a and b are both between about 2.5 and 2.8 times both c and d.

Figure 30:
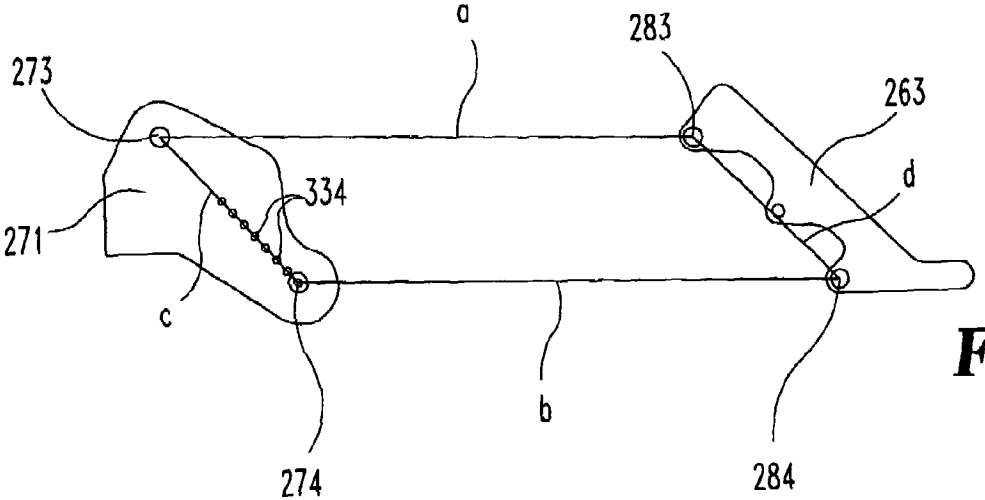

Another embodiment is shown in FIG. 30 where mounting plate 271 is provided with a series of holes 334, and pin 274 releasably, pivotally connects link b (linkage arm 262) to link c (mounting plate 271) at any desired one of holes 334.

Figure 31:
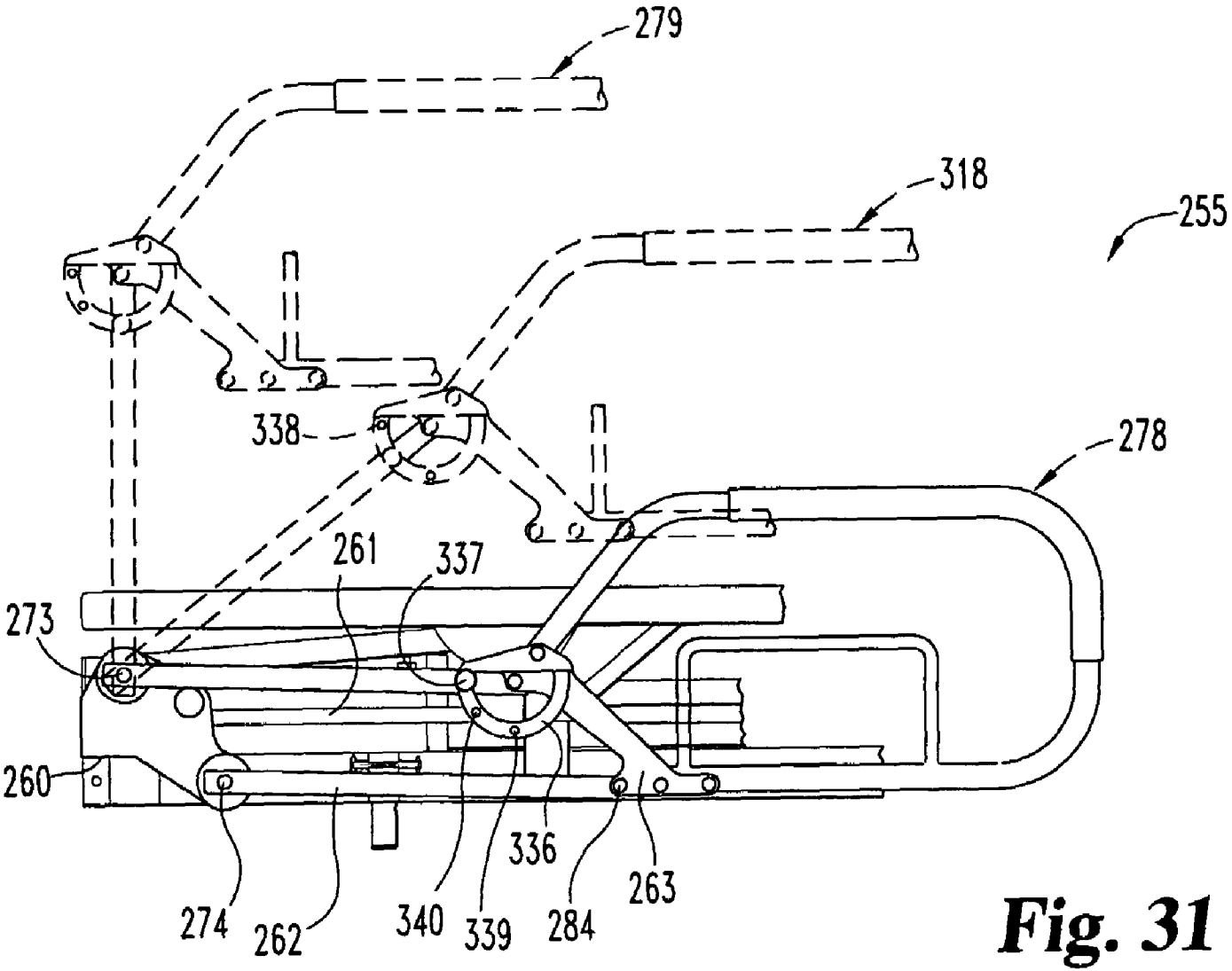
FIG. 31 is a side view of an alternative embodiment of the side rail position control assembly 266 of side rail assembly 255 of FIG. 18, which a protractor plate 336.

Alternative embodiments are contemplated wherein side rail position control assembly 266 is configured alternatively, the principal operation of which is to provide releasable setting of side rail assembly 255 at and between the up and down positions, 279 and 278, respectively. Such alternative configurations include, but are not limited to a base plate and set bar configuration (as shown in FIG. 29). Another configuration is shown in FIG. 31 where a protractor plate 336 is rigidly connected to connector bracket 263 and has three holes defined along an arcuate portion thereof, as shown. In the down position 278, upper linkage arm 261 is pivotally connected at its outboard end to protractor plate 336 by a releasable pin or knob 337 extending through then aligned locking holes 338 (in protractor plate 336) and in linkage arm 261 (latter hole in arm 261 not shown). Two other locking holes 339 and 340 along protractor plate 336 provide settings for side rail assembly 255 at the up position 279 and intermediate position 318, respectively, as shown.

Releasable pin or knob 337, like other such set pins referred to herein, may comprise any appropriate element such as, and without limitation, a pin and knob combination that is spring biased (not shown) to cause such knob to automatically engage and stay engaged until manually released. Knob 337 may also include an enhanced releasable locking feature, such as being threadedly received by one or both of linkage arm 261 and protractor plate 336, which would allow the user to tighten side rail assembly 255 in the desired position. Alternative embodiments are contemplated wherein pin 313 has a similar lockability configuration, as with a threaded bolt feature, to enable side rail assembly 255 of FIG. 18 to be releasably locked in a desired position, either at notches 308 or 309 or end 310, or anywhere in between. This would provide a more stable "releasable locking" of side rail assembly 255, at least in the down position. Such spring-biased and/or threaded pin and knob combinations are common and well known elements.

Other alternative configurations are contemplated to include active connections devices such as, but not limited to, a powered actuator similar to linear actuator 175, such actuator being connected between pins 306 and 313. Control of such actuator would be provided at control unit 267 to enable access by the person in the bed to remotely articulate side rail assembly 255.

The present embodiment is shown with just one side rail assembly 255, which is mounted to the right side of bed frame 10. A similar, but mirror-image side rail assembly (not shown) is contemplated to be directly connected to main frame 11 on the left side of bed frame 10. Such left-side side rail assembly may carry no control unit, the only control unit 267, or a second control unit (not shown). In the latter case, such second control unit could be configured and wired to control the vertical adjustment apparatus (e.g. the bed lift drive assembly 190 of FIG. 15), a radio or television, or any other desired apparatus or communication device.

While the invention has been illustrated and described in detail in the drawings and foregoing description, the same is to be considered as illustrated and not restrictive in character, it being understood that only the preferred embodiment has been shown and described and that all changes and modifications that come within the spirit of the invention are desired to be protected.

What is claimed is:

1. An articulating side rail assembly for a bed having a bed frame with a horizontal position, comprising:

a mounting bracket connectable to said bed frame;

a handle assembly;

first and second linkage arms each having first and second ends and each being pivotally connected at their first ends at first and second pivot axes to said mounting bracket and at their second ends at third and fourth pivot axes to said handle assembly to permit said side rail assembly to articulate generally in a common plane between a down position and an up position, and wherein a is the distance between first and third pivot axes, b is the distance between second and fourth pivot axes, c is the distance between first and second pivot axes, and d is the distance between third and fourth pivot axes, and wherein in the down position, said handle assembly is entirely lateral of the first and second pivot axes; and, a position control assembly connected with at least one of said handle assembly and said first and second linkage arms for releasably locking said side rail assembly in at least one of the down and up positions.

2. The articulating side rail assembly for a bed of claim 1 wherein said handle assembly comprises at least one connector bracket and a handle.

3. The articulating side rail assembly for a bed of claim 2 wherein said handle is generally C-shaped having opposing ends that are connected to the at least one connector bracket.

4. The articulating side rail assembly for a bed of claim 2 wherein said handle assembly includes a friction grip slidably received on the handle.

5. The articulating side rail assembly for a bed of claim 2 wherein said handle is generally C-shaped having angled, top, front and bottom sections, the angled and bottom sections being connected to the at least one connector bracket.

6. The articulating side rail assembly for connection to a bed of claim 2 wherein there are two connector brackets and the second ends of said first and second linkage arms are pivotally connected to and between the two connector brackets.

7. The articulating side rail assembly for a bed of claim 6 wherein said handle is generally C-shaped having angled, top, front and bottom sections, the angled and bottom sections being connected to and between the two connector brackets.

8. The articulating side rail assembly for a bed of claim 7 further including a control unit connected to and extending upwardly from the bottom section.

9. The articulating side rail assembly for a bed of claim 1 wherein the first and second pivot axes are spaced apart and along a line that is between about 40° and 50° to horizontal.

10. The articulating side rail assembly for a bed of claim 9 wherein said mounting bracket includes a pivot stop engageable with one of said linkage arms to preclude articulation of said side rail assembly beyond one of the up and down positions.

11. The articulating side rail assembly for a bed of claim 1 wherein said position control assembly is connected between said handle assembly and said first linkage arm.

12. The articulating side rail assembly for a bed of claim 1 wherein a=b and c=d.

13. The articulating side rail assembly for a bed of claim 1 wherein a≠b.

14. The articulating side rail assembly for a bed of claim 1 wherein c≠d.

15. The articulating side rail assembly for a bed of claim 1 wherein both a and b are between about 2 and 3 times both c and d.

16. The articulating side rail assembly for a bed of claim 15 wherein both a and b are between about 2.5 and 2.7 times both c and d.

17. An articulating side rail assembly for a bed having a bed frame with a horizontal position, comprising:

a mounting bracket connectable to a bed frame;

a handle assembly;

first and second linkage arms each having first and second ends and each being pivotally connected at their first ends at first and second pivot axes to said mounting bracket and at their second ends at third and fourth pivot axes to said handle assembly to permit said side rail assembly to articulate between a down position and an up position, and wherein a is the distance between first and third pivot axes, b is the distance between second and fourth pivot axes, c is the distance between first and second pivot axes, and d is the distance between third and fourth pivot axes, and wherein in the down position, said handle assembly is entirely lateral of the first and second pivot axes;

a position control assembly connected with at least one of said handle assembly and said first and second linkage arms for releasably locking said side rail assembly in at least one of the down and up positions; and, wherein said position control assembly includes a guide arm connected to said first linkage arm and includes a set link connected at a first end to said handle assembly and variably connected at a second end to the guide arm.

18. The articulating side rail assembly for a bed of claim 17 wherein the set link is pivotally connected at its first end to said handle assembly.

19. The articulating side rail assembly for a bed of claim 17 wherein the set link defines a slot and the guide arm has a pin disposed to follow within the slot of the set link, the shape of the slot defining releasable locking positions that include the down and up position.

20. The articulating side rail assembly for a bed of claim 19 wherein the slot of the set link defines at least one notch for defining one of the releasable locking positions.

21. The articulating side rail assembly for a bed of claim 19 wherein the slot of the set link defines at least one intermediate position between the down and up position.

22. A method for articulating a side rail assembly for a bed, the bed having a bed frame with a horizontal position, comprising:

providing an articulating side rail assembly that includes:

a mounting bracket connectable to said bed frame, a handle assembly, first and second linkage arms each having first and second ends and each being pivotally connected at their first ends at first and second pivot axes to said mounting bracket and at their second ends at third and fourth pivot axes to said handle assembly to permit said side rail assembly to articulate generally in a common plane between a down position and an up position, and wherein a is the distance between first and third pivot axes, b is the distance between second and fourth pivot axes, c is the distance between first and second pivot axes, and d is the distance between third and fourth pivot axes, and wherein in the down position, said handle assembly is entirely lateral of the first and second pivot axes, and a position control assembly connected with at least one of said handle assembly and said first and second linkage arms for releasably locking said side rail assembly in at least one of the down and up positions;

mounting said side rail assembly to a bed by connecting the said mounting bracket to the bed frame;

moving said handle assembly as said first and second linkage arms pivot about the first and second pivot axes until said position control assembly releasably locks said side rail assembly in one of the down and up positions.

23. The method for articulating a side rail assembly for a bed of claim 22 wherein said providing step includes the articulating side rail assembly having at least one alternative position different from the down and up positions and the position control assembly being operable to releasably lock the side rail assembly in any of the down, up and alternative positions.

* * * * *